US012352144B2

(12) United States Patent
Phan et al.

(10) Patent No.: US 12,352,144 B2
(45) Date of Patent: Jul. 8, 2025

(54) ELUTION SYSTEMS FOR TREATMENT OF SUBTERRANEAN RESERVOIRS

(71) Applicant: ChampionX LLC, Sugar Land, TX (US)

(72) Inventors: Tri Thanh Phan, Rosenberg, TX (US); Jeremy Moloney, Katy, TX (US); Miguel A. Balzan, Sugar Land, TX (US); Rogelio A. Banda, Houston, TX (US); Wilfredis Jose Medina, Richmond, TX (US); Gedeng Ruan, Houston, TX (US)

(73) Assignee: ChampionX LLC, Sugar Land, TX (US)

( * ) Notice: Subject to any disclaimer, the term of this patent is extended or adjusted under 35 U.S.C. 154(b) by 0 days.

(21) Appl. No.: 18/666,224

(22) Filed: May 16, 2024

(65) Prior Publication Data

US 2024/0392665 A1 Nov. 28, 2024

Related U.S. Application Data

(60) Provisional application No. 63/468,035, filed on May 22, 2023.

(51) Int. Cl.
*E21B 41/02* (2006.01)
*E21B 43/16* (2006.01)

(52) U.S. Cl.
CPC ..... *E21B 43/16* (2013.01); *E21B 41/02* (2013.01)

(58) Field of Classification Search
CPC ..... E21B 41/02; E21B 43/16
See application file for complete search history.

(56) References Cited

U.S. PATENT DOCUMENTS 2,801,697 A * 8/1957 Rohrback ..... E21B 41/02 507/275
3,053,320 A * 9/1962 Steincamp ..... E21B 41/02 166/68

(Continued)

FOREIGN PATENT DOCUMENTS

CA 2804607 C 1/2017
CA 2820944 C 11/2018

(Continued)

OTHER PUBLICATIONS

International Search Report mailed in International Application No. PCT/US24/29702 on Oct. 11, 2024, 6 pages.

(Continued)

*Primary Examiner* — Matthew R Buck
(74) *Attorney, Agent, or Firm* — Kagan Binder, PLLC

(57) ABSTRACT

Methods for treating a producing wellbore of a subterranean reservoir include obtaining a side stream flow of a produced fluid from a production tube of the wellbore at a location above the surface of the earth; providing an eluting contact of the side stream flow of produced fluid with a treatment material to form a side stream flow of treated produced fluid; and directing the side stream flow of treated produced fluid into the wellbore at a point below the surface of the earth. Apparatuses suitable for carrying out the methods include an elution device fluidly connected to a side stream of produced fluid flowing above the surface of the earth and situated to direct the side stream toward the elution device to provide an eluting contact of the produced fluid with a treatment material disposed in the elution device, then direct the treated produced fluid into the wellbore.

25 Claims, 3 Drawing Sheets

(56) References Cited

U.S. PATENT DOCUMENTS

| | | | | |
|---|---|---|---|---|
| 3,710,867 | A * | 1/1973 | Bansbach | E21B 41/02 166/244.1 |
| 4,064,936 | A * | 12/1977 | McClure | E21B 33/068 166/268 |
| 5,103,914 | A * | 4/1992 | LaHaye | E21B 37/06 166/310 |
| 6,343,653 | B1 * | 2/2002 | Mason | E21B 37/06 166/310 |
| 6,461,414 | B1 | 10/2002 | Kohl et al. | |
| 6,758,277 | B2 | 7/2004 | Vinegar et al. | |
| 7,004,258 | B2 | 2/2006 | Farris | |
| 7,117,947 | B2 | 10/2006 | Wilson | |
| 7,243,726 | B2 | 7/2007 | Ohmer | |
| 7,537,705 | B2 * | 5/2009 | Voeller | C23F 14/02 210/698 |
| 7,556,100 | B2 | 7/2009 | Steiner | |
| 7,654,314 | B2 | 2/2010 | Farris | |
| 7,721,806 | B2 | 5/2010 | Ayres | |
| 7,886,822 | B2 | 2/2011 | Garcia-Lopez De Victoria et al. | |
| 7,918,281 | B2 | 4/2011 | Brown et al. | |
| 8,418,757 | B2 | 4/2013 | Lyublinski et al. | |
| 8,469,103 | B2 | 6/2013 | Barry | |
| 9,016,383 | B2 | 4/2015 | Shampine et al. | |
| 9,127,542 | B2 | 9/2015 | Tallini | |
| 9,528,350 | B2 | 12/2016 | Lunde et al. | |
| 9,856,721 | B2 | 1/2018 | Reid et al. | |
| 10,280,714 | B2 * | 5/2019 | Fouchard | C09K 8/524 |
| 10,323,513 | B2 | 6/2019 | de Oliveira et al. | |
| 10,669,470 | B2 * | 6/2020 | Fouchard | E21B 41/02 |
| 10,717,918 | B2 * | 7/2020 | Fouchard | E21B 37/06 |
| 10,730,818 | B2 | 8/2020 | Trahan | |
| 10,913,887 | B2 | 2/2021 | Davis | |
| 10,968,727 | B2 | 4/2021 | Dusterhoft et al. | |
| 11,162,328 | B2 * | 11/2021 | Rodriguez | E21B 37/06 |
| 11,261,705 | B2 | 3/2022 | Wang et al. | |
| 11,401,787 | B2 | 8/2022 | Al-Anazi et al. | |
| 12,005,407 | B2 * | 6/2024 | Soliman | B01F 25/31242 |
| 2004/0043906 | A1 | 3/2004 | Steincamp | |
| 2005/0127089 | A1 * | 6/2005 | Schacher | F17D 3/01 222/1 |
| 2006/0231254 | A1 * | 10/2006 | Peskunowicz | B01F 25/316 166/278 |
| 2012/0217012 | A1 * | 8/2012 | Darby | E21B 37/06 166/305.1 |
| 2022/0235644 | A1 | 7/2022 | Orlov et al. | |
| 2023/0399560 | A1 | 12/2023 | Moloney | |

FOREIGN PATENT DOCUMENTS

| | | | |
|---|---|---|---|
| WO | 98/57030 | A1 | 12/1998 |
| WO | 2022159626 | A1 | 7/2022 |

OTHER PUBLICATIONS

Written Opinion mailed in International Application No. PCT/US24/29702 on Oct. 11, 2024, 9 pages.

* cited by examiner

ELUTION SYSTEMS FOR TREATMENT OF SUBTERRANEAN RESERVOIRS

TECHNICAL FIELD

The invention relates generally to elution systems for treating subterranean reservoirs.

BACKGROUND

Hydrocarbon (oil and gas) recovery requires a plethora of equipment to complete the safe and efficient recovery of fluid produced from a subterranean reservoir, including transfer of the produced fluid to the surface of the earth for processing and refinement to provide one or more useful hydrocarbon products. Primary components in a "completion string" for an oil or gas well include the well casing, which is inserted into a wellbore of a subterranean reservoir to stabilize the well annulus and promote a flow of produced fluid therein; production tubing, which is the main conduit for fluids produced from the reservoir and flowing into the wellbore annulus to reach the earth's surface; and associated conduits and flow controls between the production tubing and a processing and refinement area where the produced fluid is processed and refined to result in one or more useful hydrocarbon products. Additional completion components include packers, downhole gauges, and the like; landing nipples, which are short sections of heavy wall pipe or tubing placed along the completion string to allow for well testing, installation of flow-control devices such as plugs and chokes, and/or interventions to be carried out safely; and the so-called "Christmas tree", which is an assembly of valves, pressure gauges, spools, and chokes located at the wellhead (the end of the wellbore located at the earth's surface). The Christmas tree conducts fluid emanating from the wellhead via the production tubing toward the processing and refinement area where processing and refining of one or more hydrocarbon products is carried out.

The extraction of oil and gas is intrinsically associated with produced fluid emanating from the subterranean reservoir. The produced fluid enters the wellbore from the reservoir with sufficient force to cause a flow thereof to reach a point at or above the surface of the earth, further as directed by the production tubing. Produced fluids include mixtures of water, hydrocarbons, and other compounds and/or solid materials dissolved, dispersed, or entrained therein. Produced fluids typically include one or more compounds that are corrosive to the well completion components as well as downstream processing equipment. Conditions of produced fluid temperature, pH, presence and concentration of corrodents such as chlorides, $H_2S$, and $CO_2$ determine the extent of adverse effects on the material performance of equipment components contacted by produced fluid during recovery and processing thereof.

Nearly all operators in the hydrocarbon extraction and processing industry employ corrosion inhibitors to reduce internal corrosion in metal containments, conduits, and other components that are contacted by produced fluids containing corrodents. Corrosion inhibitors are added to the liquids and dissolved gasses which come into contact with metal surfaces in the completion string and processing and refinement equipment, where they act to prevent, retard, delay, reverse, and/or otherwise inhibit the corrosion of metal surfaces, such as carbon-steel metal surfaces. Such use of corrosion inhibitors is recognized to be highly beneficial for extending equipment lifetime. In some cases, effective use of corrosion inhibitors may enable the operator to use carbon steel components in place of expensive high nickel, cobalt, and chromium alloys or other materials.

Corrosion inhibitors in the oil and gas industry are sold in a range of formats, including in liquid forms such as neat liquids and concentrated or dilute solutions, dispersions, or emulsions; in semisolid forms such as gels; in solid forms such as pellets or tablets that are applied to the reservoir to dissolve downhole; in encapsulated forms such as a liquid, gel, or tablet encapsulated (surrounded) by polymer coating; or another composite format including one or more corrosion inhibitors and one or more other materials. The corrosion inhibitors are effective to inhibit corrosion within the well completion string as well as the downstream processing and refinement equipment (collectively, hydrocarbon recovery and processing equipment) when applied at a sufficient concentration in a produced fluid entering hydrocarbon recovery and processing equipment, or when applied to provide a sufficient passivation layer or coating layer on the surfaces of the hydrocarbon recovery and processing equipment.

However, the ability to inject or otherwise provide effective treatments to the interior surfaces of hydrocarbon recovery and processing equipment, in particular to the completion string of a producing wellbore, is a challenge that has not been well-addressed by the industry. In some cases, the infrastructure of the wellbore is appended with one or more means of applying a coating to one or more interior surfaces of the completion string, such as pigging, which is expensive, requires bespoke configuration, and often requires a period of shutdown to clean out one or more parts of a completion string before a fresh coating of polymer or passivation compound can be applied thereto. More commonly, corrosion inhibitors are periodically applied batchwise to a producing wellbore, in amounts empirically based on well production volume. This method does not always result in effective inhibition of corrosion for the entire period between batch treatments, since efficacy trails off over time as fluid concentration decreases and/or surface coatings degrade. Further, batch treatment is inefficient because of the need to transport both the treatment material and equipment to inject the treatment material to the site of the wellbore for each treatment, usually by truck. Further, each batch treatment requires a large volume of adjuvant water, such as about 350 liters to about 600 liters (about to 95 gallons to about 160 gallons) per batch, to dilute and flush the batch into the wellbore and provide effective distribution of the treatment material to the produced fluid, or to the interior surfaces of the hydrocarbon recovery and processing equipment, or both. The adjuvant water must be transported to the treatment site along with the treatment material and injection equipment.

Accordingly, there is an ongoing need in the oil and gas extraction industry for methods, apparatuses, and systems for applying treatments, such as corrosion inhibition treatments, to the surfaces of hydrocarbon recovery and processing equipment that are contacted with produced fluid with greater efficiency than provided by batch treatment; with increased case of use of methods and apparatuses for applying the treatments; and without the equipment cost and periodic downtime required by automated on-board application equipment such as pigs.

SUMMARY

Disclosed herein are first passive elution systems including an elution device defining an interior volume having an outlet therefrom, the outlet situated at or near the bottom of the elution device, where the interior volume includes a treatment material; and a conduit in fluid communication with the outlet and arranged and adapted to receive a produced fluid flow from a wellbore of a subterranean reservoir at a location above the surface of the earth, direct the produced fluid flow to provide an eluting contact with the treatment material to form a treated produced fluid flow, and direct the treated produced fluid flow into the wellbore.

In embodiments, the elution device of the first passive elution system is situated on or above the surface of the earth.

In embodiments, the treated produced fluid flow of the first passive elution system is directed into the wellbore at a location at or below the surface of the earth.

In embodiments, the produced fluid flow received from the wellbore by the first passive elution system is a side stream of a production tube.

In embodiments, the first passive elution system excludes external or applied sources of power to receive the produced fluid flow, direct the produced fluid flow to provide the eluting contact with the treatment material, or direct the treated produced fluid flow into the wellbore.

In embodiments, the treatment material of the first passive elution system is a treatment solid, for example a composite treatment solid. In embodiments, the composite treatment solid is a polymer pouch enclosing a treatment liquid, wherein the polymer is water soluble.

In embodiments, the elution device of the first passive elution system excludes an inlet.

In embodiments, the first passive elution system includes a valve disposed between the elution device outlet and the conduit.

In embodiments, the first passive elution system further includes a basket disposed between the elution device outlet and the conduit.

Also disclosed herein are second passive elution systems including an elution device defining an interior volume having an inlet and an outlet, where the inlet is situated on or near the top of the elution device during operation of the passive elution system, and the outlet is situated on or near to the bottom of the elution device during operation of the passive elution system, and wherein the interior volume includes a treatment material; a first conduit in fluid communication with the inlet and arranged and adapted to receive a produced fluid flow from a wellbore of a subterranean reservoir at a location above the surface of the earth, and direct the produced fluid flow through the inlet to provide an eluting contact with the treatment material to form a treated produced fluid; and a second conduit in fluid communication with the outlet and arranged and adapted to receive the treated produced fluid and direct the treated produced fluid into the wellbore.

In embodiments, the elution device of the second passive elution system is situated on or above the surface of the earth.

In embodiments of the second passive elution system, the treated produced fluid flow is directed into the wellbore at a location at or below the surface of the earth.

In embodiments of the second passive elution system, the produced fluid flow received from the wellbore is a side stream of a production tube.

In embodiments the second passive elution system excludes external or applied sources of power to receive the produced fluid flow, direct the produced fluid flow to provide the eluting contact with the treatment material, or direct the treated produced fluid flow into the wellbore.

In embodiments of the second passive elution system, the treatment material is a treatment solid or a composite treatment solid. In some such embodiments, the composite treatment solid is a polymer pouch enclosing a treatment liquid, wherein the polymer is water soluble.

In embodiments the second passive elution system further comprises a float valve operably disposed in the interior volume of the elution device to stop the flow of produced through the inlet; and an outlet valve disposed between the outlet and the second conduit.

Also disclosed herein are methods of treating a wellbore of a subterranean reservoir, the methods including: obtaining a side stream flow of a produced fluid from a production tube of the wellbore, at a location above the surface of the earth; directing an eluting contact of the side stream flow of produced fluid with a treatment material to form a side stream flow of treated produced fluid; and directing the side stream flow of treated produced fluid into the wellbore at a location at or below the surface of the earth.

In embodiments the treating is continuous treating.

In embodiments the treating is batch treating. In some such embodiments, the batch treating is provided by continuous eluting contact of produced fluid with the treatment material.

In embodiments, the side stream flow of produced fluid is obtained at a flow rate of about 1 liter per hour to 10 liters per second. In other embodiments, the side stream flow rate of produced fluid is about 100 liters per hour to about 3500 liters per hour.

In embodiments, the method further includes measuring a value related to a property of the produced fluid, measuring a value related to a property of the treated produced fluid, or both; and communicating one or more measured values to a controller; wherein the controller is designed and adapted to respond to one or more communicated values by manipulating a rate of the side stream flow.

In embodiments, an elution device is operably situated on or above the surface of the earth, or is substantially situated on or above the surface of the earth. In embodiments, an elution device is mounted on a support, wherein the support is situated on or above the surface of the earth or substantially on or above the surface of the earth. In embodiments the support is or includes a component of a completion string, such as the production tubing or a landing nipple placed at the wellhead, or another part of the wellhead infrastructure, such as a production manifold, a production flow line, an oil/water transportation pipeline, or a produced fluids processing vessel; and/or two or more of these, and/or combinations of any of these. In other embodiments, the support is integral to the elution device and is appended thereto and configured to provide a desired placement of the elution device on or above the surface of the earth.

In addition to being situated on or above the surface of the earth, the elution device of the passive elution system is operably situated proximal to the wellhead of a producing wellbore, and configured to passively receive or obtain a side stream of a produced fluid therefrom as the produced fluid flows upwards from within the wellbore to reach the wellhead area located at or near the surface of the earth. The conduit of the passive elution system is fluidly connected, at a location at or above the surface of the earth, to a source of produced fluid flowing from the wellbore; and configured to passively receive a side stream flow of the produced fluid, direct the side stream to provide an eluting contact with the treatment material of the elution device to form a treated produced fluid flow, and direct the treated produced fluid flow into the wellbore of the subterranean reservoir.

Accordingly, the passive elution systems do not require external or applied sources of power to obtain operability. That is, the passive elution systems operate by directing a fluid flow, and do not require external or applied sources of power to cause or direct fluid flow through the passive elution system. Instead, the passive elution systems are designed and configured to passively receive a produced fluid flow from a wellbore, direct the produced fluid flow into an eluting contact with a treatment material to form a treated produced fluid flow, and direct the treated produced fluid flow into the wellbore.

In embodiments one or more components of the passive elution systems are provided as a mobile elution kit. In embodiments, a mobile elution kit includes an elution device having a top and a bottom and defining an interior volume therebetween, further wherein the interior volume defines an inlet and an outlet, the inlet situated on or proximal to the top of the elution device and appended by a first connector, the outlet situated on or proximal to the bottom of the elution device and appended by a second connector, wherein the interior volume comprises a treatment material; a first conduit having first conduit first end and first conduit second end, wherein first conduit first end is appended by first mated connector for mating with the first connector of the elution device to form a first sealed fluid connection, and wherein first conduit second end is appended by a third connector, wherein the third connector is adapted and configured to obtain a fluid connection with a flow of produced fluid from a production tube of a wellbore; and a second conduit having second conduit first end and second conduit second end, wherein second conduit first end appended by second mated connector for mating with the second connector of the elution device to form a second sealed fluid connection, and wherein second conduit second end is appended by a fourth connector, wherein the fourth connector is configured to obtain a fluid communication with tubing that is capable of directing a fluid flow directly into the wellbore. In some such embodiments, the first connector and the first mated connector are a first rapid connection pair; and the second connector and second mated connector are a second rapid connection pair.

In embodiments, a mobile elution kit is assembled to form a passive elution system. In embodiments a mobile elution kit obtains one or more use cycles, where one use cycle includes the steps of a) assembling a mobile elution kit to form a passive elution system in fluid contact with a wellbore; b) treatment of the wellbore by allowing an eluting contact of a produced water from the wellbore with a treatment material disposed within the elution device of the passive elution system; and c) disassembly of the passive elution system and reformation of the mobile elution kit. In some embodiments, the mobile elution kit is transported between any one or more use cycles. In embodiments, an elution kit is transported using a street vehicle such as a pickup truck or a sedan.

DETAILED DESCRIPTION

Figure 1:
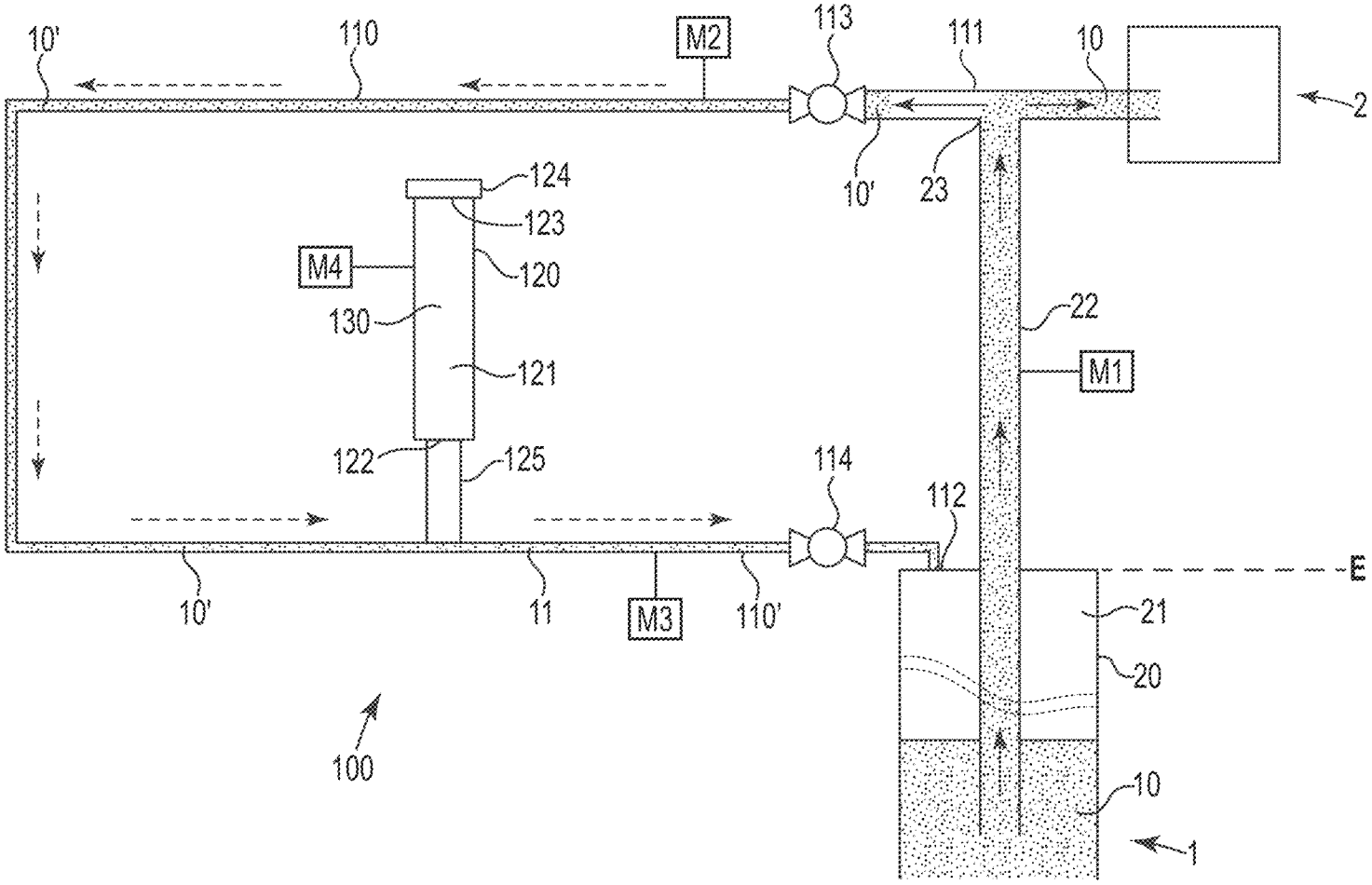
FIG. 1 is a diagram of a passive elution system of first embodiments herein.

Although the present disclosure provides references to preferred embodiments, persons skilled in the art will recognize that changes may be made in form and detail without departing from the spirit and scope of the invention. Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Definitions

As used herein, the terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

As used herein, the term "optional" or "optionally" means that the subsequently described event or circumstance may but need not occur, and that the description includes instances where the event or circumstance occurs and instances in which it does not.

As used herein, the term "about" modifying, for example, the quantity of an ingredient in a composition, concentration, volume, process temperature, process time, yield, flow rate, pressure, and like values, and ranges thereof, employed in describing the embodiments of the disclosure, refers to variation in the numerical quantity that can occur, for example, through typical measuring and handling procedures used for making compounds, compositions, concentrates or use formulations; through inadvertent error in these procedures; through differences in the manufacture, source, or purity of starting materials or ingredients used to carry out the methods, and like proximate considerations. The term "about" also encompasses amounts that differ due to aging of a formulation with a particular initial concentration or mixture, and amounts that differ due to mixing or processing a formulation with a particular initial concentration or mixture. Where modified by the term "about" the claims appended hereto include equivalents to these quantities. Further, where "about" is employed to describe a range of values, for example "about 1 to 5" the recitation means "1 to 5", "about 1 to about 5", "1 to about 5" and "about 1 to 5" unless specifically limited by context.

As used herein, the word "substantially" modifying, for example, the type or quantity of an ingredient in a composition, a property, a measurable quantity, a method, a position, a value, or a range, employed in describing the embodiments of the disclosure, refers to a variation that does not affect the overall recited composition, property, quantity, method, position, value, or range thereof in a manner that negates an intended composition, property, quantity, method, position, value, or range. Examples of intended properties include, solely by way of non-limiting examples thereof, flexibility, partition coefficient, rate, solubility, temperature, and the like; intended values include thickness, yield, weight, concentration, and the like. The effect on methods that are modified by "substantially" include the effects caused by variations in type or amount of materials used in a process, variability in machine settings, the effects of ambient conditions on a process, and the like wherein the manner or degree of the effect does not negate one or more intended properties or results; and like proximate considerations. Where modified by the term "substantially" the claims appended hereto include equivalents to these types and amounts of materials.

First Embodiments

In first embodiments of the passive elution systems herein, the elution device comprises, consists essentially of, or consists of a containment defining an interior volume having an outlet therefrom, wherein the elution device interior volume encloses and includes a treatment material; and the outlet of the elution device is defined on or near the gravitational bottom thereof during operation of the passive elution system and/or when the elution device is mounted on a support. The elution device outlet is in fluid communication with a conduit configured to provide an eluting contact of the treatment material with a produced fluid flow at the outlet or proximal to the outlet. Accordingly, in first embodiments herein, upon establishing fluid communication between the conduit and a produced fluid flow, the flow of produced fluid is received by the conduit and is directed toward the elution device; the produced fluid flow contacts the treatment material at the outlet or proximal to the outlet of the elution device in an eluting contact to form a treated produced fluid flow; and the treated produced fluid flow is directed through the conduit and is dispensed into a wellbore of the subterranean reservoir.

FIG. 1 shows one example of a passive elution system of first embodiments. In FIG. 1, producing wellbore 1 includes well casing 20 disposed beneath the surface of the earth, where the surface of the earth is represented by dashed line E. Well casing 20 defines well annulus 21. During production, a produced fluid 10 gathers within well annulus 21 and is directed by production tubing 22 to a point at or above the surface of the earth E, and toward a processing facility 2 where it is processed to provide one or more useful hydrocarbon products. Passive elution system 100 is fluidly connected to production tubing 22 at side stream takeoff 23. Side stream takeoff 23 is a point along production tubing 22 that is at or above the surface of the earth E. In embodiments, side stream takeoff 23 is located at or proximal to the wellhead, that is, near the end of wellbore 1 located at or near the surface of the earth E.

As shown in FIG. 1, a "main" stream of produced fluid 10 flows from wellbore 1 through production tubing 22 and toward a processing facility 2, in the direction shown by the solid arrows. A side stream of produced fluid 10' is obtained at side stream takeoff 23. Side stream takeoff 23 is a fluid connection between production tubing 22 and side stream tubing 110 at a first end 111 thereof. In embodiments, side stream takeoff 23 is an opening defined in production tubing 22. In embodiments side stream takeoff 23 further includes one or more fittings or additional infrastructure necessary to complete a fluid connection between production tubing 22 and first end 111 of side stream tubing 110.

Side stream tubing 110 is an annular conduit such as a pipe or tube that is formed from rubber, plastic, metal, or a combination of these materials, further as selected by the operator. Side stream tubing 110 includes an inner diameter that is less than the inner diameter of the production tubing. In embodiments, side stream tubing 110 includes an inner diameter that is selected by the operator to provide a flow rate of side stream 10' that is suitable for the eluting contact, as discussed below. In embodiments, side stream tubing 110 has an inner diameter of about 1 mm to about 20 cm, or about 3 mm to about 20 cm, or about 5 mm to about 20 cm, or about 1 cm to about 20 cm, or about 2 cm to about 20 cm, or about 2 cm to about 20 cm, or about 3 cm to about 20 cm, or about 4 cm to about 20 cm, or about 5 cm to about 20 cm, or about 7 cm to about 20 cm, or about 9 cm to about 20 cm, or about 10 cm to about 20 cm, or about 12 cm to about 20 cm, or about 14 cm to about 20 cm, or about 16 cm to about 20 cm, or about 18 cm to about 20 cm, or about 1 mm to about 18 cm, or about 1 mm to about 16 cm, or about 1 mm to about 14 cm, or about 1 mm to about 12 cm, or about 1 mm to about 10 cm, or about 1 mm to about 8 cm, or about 1 mm to about 6 cm, or about 1 mm to about 4 cm, or about 1 mm to about 3 cm, or about 1 mm to about 2 cm, or about 1 mm to about 1 cm, or about 1 mm to about 5 mm, or about 1 cm to about 2 cm, or about 2 cm to about 3 cm, or about 3 cm to about 4 cm, or about 4 cm to about 6 cm, or about 6 cm to about 8 cm, or about 8 cm to about 10 cm, or about 10 cm to about 12 cm, or about 12 cm to about 14 cm, or about 14 cm to about 16 cm, or about 16 cm to about 18 cm, or about 5 mm to about about 3 cm, or about 1 mm to about 5 mm, or about 5 mm to about 1 cm, or about 1 cm to about 10 cm, or about 5 cm to about 20 cm. In embodiments side stream tubing 110 is flexible plastic or rubber tubing such as Tygon tubing, Teflon® tubing, or Viton® tubing (available from distributors such as McMaster-Carr® of Santa Fe Springs, CA).

In the passive elution system 100 of FIG. 1, side stream valve 113 is disposed between side stream takeoff 23 and side stream tubing 110 first end 111 to provide an adjusted flow of side stream 10' to enter side stream tubing 110, further wherein the direction of flow of side stream 10' is indicated in FIG. 1 by dashed arrows. Side stream valve 113 is operable to adjust the flow of side stream 10' received by side stream tubing 110. Accordingly, side stream valve 113 may be open to allow a flow, or closed prevent a flow; or may be adjustable to partially obstruct a flow. Thus, in embodiments, side stream valve 113 is configured to provide control of the rate of flow of produced fluid 10' into side stream tubing 110. In one or more such embodiments, side stream valve 113 may be manipulated by an operator to decrease or increase the flow of side stream 10' into side stream tubing 110 as needed.

In other first embodiments of the passive elution system similar the passive elution system 100 of FIG. 1, there is no side stream valve disposed between side stream takeoff 23 and first end 111 of side stream tubing 110.

Accordingly, in the passive elution system 100 of FIG. 1, the flow of side stream 10' into and through side stream tubing 110 is caused by and maintained by the fluid communication of side stream tubing 110 with produced fluid moving upwards through production tubing 22. Side stream 10' is thereby caused to flow through side stream tubing 110 in the direction shown by the dashed arrows, from first end 111 to second end 112 of side stream tubing 110. The flow of the side stream 10' may be further adjusted, controlled, or stopped by manipulating side stream valve 113 to provide a selected flow rate of produced fluid into and through side stream tubing 110.

Further as shown in FIG. 1, elution device 120 is a containment defining an interior volume 121 having an outlet 122 therefrom, wherein outlet 122 is in fluid communication with side stream tubing 110 at a location between first end 111 and second end 112. Elution device 120 contains a treatment material 130 disposed within interior volume 121.

In embodiments, the elution device has an overall cuboid shape, that is, a cubic or a rectangular parallelepiped shape.

In other embodiments, the elution device has an overall cylindrical shape, or a funnel type shape, or a combination of a cylindrical shape with a funnel shape portion. Since the elution device is disposed substantially above ground level, it may be generally visible and so decorative shape or other decorative or camouflaging features are employed in some embodiments associated with the elution device, the passive elution system, or portions thereof.

Elution device 120 further includes elution assemblage 125 disposed between outlet 122 and side stream tubing 110. Elution assemblage 125 facilitates the eluting contact between the treatment material 130 and the side stream 10'. In the embodiment shown in FIG. 1, elution device 120 further defines an access opening 123 to the interior volume 121 thereof, and a removable cap 124 that is designed and arranged to cover opening 123. In some embodiments cap 124 is designed and arranged to seal interior volume 121 from the surrounding atmosphere and/or prevent pressure equilibration of the interior volume 121 with the environment external to passive elution system 100 during operation thereof. Access opening 123 provides access to interior volume 121 of elution device 120 for addition of replacement treatment material, cleaning, and/or other interventions.

In other first embodiments of the passive elution system similar the passive elution system 100 of FIG. 1, elution device 120 has no access opening or cap; in such embodiments elution device 120 is a single-use cartridge that is pre-loaded with a treatment material 130 and is capable of being removably attached to side stream tubing 110 to provide eluting contact with side stream 10'. In some such embodiments, the single-use cartridges may be returned to the supplier after the pre-loaded treatment material is depleted from the interior volume thereof due to eluting contact as described herein. In embodiments, the single-use cartridges are refilled by the supplier or recycled.

Further as shown in FIG. 1, second end 112 of side stream tubing 110 is located proximal to or within producing wellbore 1 and arranged to dispense treated side stream 11 into the well annulus 21 defined by the well casing 20. Accordingly, second end 112 of side stream tubing 110 is located near the surface of the earth, at the surface of the earth, or below the surface of the earth; and proximal to or disposed within well annulus 21.

In the embodiment of FIG. 1, dispensing valve 114 is disposed between outlet 122 and second end 112 of side stream tubing 110 to regulate the dispensing of treated side stream 11 from second end 112 by opening, closing, or partially obstructing the flow of treated side stream 11 as it proceeds toward second end 112. Thus, in embodiments, dispensing valve 114 is configured to provide flow control; that is, in embodiments dispensing valve 114 may be opened or shut; in some embodiments dispensing valve 114 is adjustable between open and shut to provide a selected flow rate of treated side stream 11 from second end 112 of side stream tubing 110. Accordingly, in such embodiments, dispensing valve 114 may be manipulated by an operator to decrease or increase the flow of treated side stream 11 as needed. Further, side stream valve 113 and dispensing valve 114 may both be manipulated independently or in concert to stop, start, increase, or decrease overall flow rate within side stream tubing 110.

In other first embodiments of the passive elution system similar to the system of FIG. 1, there is no dispensing valve 114 disposed between outlet 122 and second end 112 of side stream tubing 110. In some such embodiments, there is also no side stream valve 113; that is, in embodiments as selected by the operator, passive elution system 100 may include a side stream valve, a dispensing valve, both a side stream valve and a dispensing valve, or neither a side stream valve nor a dispensing valve.

In some first embodiments of the passive elution system similar to the embodiments of FIG. 1, second end 112 of side stream tubing 110 is appended with one or more additional fittings for controlling the flow of treated produced fluid to the wellbore, such as directional flow or spray nozzle fittings; a weighted fitting attached to side stream tubing 110 proximal to second end 112 in order to maintain weighted placement of second end 112 disposed within well annulus 21; and/or one or more fittings affixing side stream tubing 110 to the well casing 20 near second end 112, for example clamps, clips, braces, brackets, and/or other fittings to mechanically affix, secure, or fasten side stream tubing 110 to well casing 20 to maintain a consistent location of dispensing.

Further as shown in FIG. 1, elution device 120 includes elution assemblage 125 which is designed and configured to provide an eluting contact of produced fluid side stream 10' with treatment material 130. Accordingly, as side stream 10' flows through side stream tubing 110 and past outlet 122, eluting contact is provided by elution assemblage 125, causing elution of a portion of treatment material 130 into the produced fluid to form an eluate, and converting side stream 10' into treated side stream (or eluate stream) 11. Treated side stream 11 is thus formed within elution assemblage 125 at a point proximal to outlet 122, further as the side stream flow proceeds through side stream tubing 110. Treated side stream 11 flows toward second end 112 of side stream tubing 110, where it is dispensed from the passive elution system 100 into the producing wellbore 1. During the dispensing, that is, during operation of passive elution system 100, treated side stream 11 flows from second end 112 of side stream tubing 110 into wellbore 1 to form a treated wellbore. In embodiments such as that shown in FIG. 1, the dispensing is dispensing into the well annulus 21 defined by well casing 20.

Elution assemblage 125 is disposed between and fluidly connected to outlet 122 of elution device 120 and side stream tubing 110. Elution assemblage 125 provides or facilitates eluting contact between the treatment material and the produced fluid side stream 10'. One or more of the following are usefully employed as elution assemblage 125 or as part of the elution assemblage 125 in the passive elution system 100 of FIG. 1 to achieve eluting contact of the produced fluid with the treatment material to form a treated produced fluid. Accordingly, exemplary elution assemblages 125 of FIG. 1 are 125*a*, 125*b* and 125*c* described below, further wherein elution assemblage 125 in FIG. 1 is exemplary of each of 125*a*, 125*b* and 125*c*, but 125*a*, 125*b* and 125*c* are not shown in FIG. 1.

A first exemplary elution assemblage 125 of the passive elution system 100 of FIG. 1 comprises, consists essentially of, or consists of an outlet tube, 125*a*, disposed between outlet 122 of elution device 120 and side stream tubing 110. Outlet tube 125*a* includes an inner diameter to provide a selected rate of treatment material flow from the interior volume 121 of elution device 120 through outlet 122 to contact side stream 10', further as facilitated by gravity.

A second exemplary elution assemblage 125 of the passive elution system 100 of FIG. 1 comprises, consists essentially of, or consists of a valve, 125*b*, disposed between outlet 122 of elution device 120 and side stream tubing 110. Valve 125*b* is adjustable to provide a selected rate of treatment material flow from the interior volume 121 of elution device 120 through outlet 122, further as facilitated by gravity.

Accordingly, in embodiments where the elution assemblage 125 of FIG. 1 is tube 125*a* or valve 125*b*, the treatment material present in the interior volume 121 of elution device 120 is characterized as a treatment liquid. A treatment liquid is a solution, dispersion, gel, paste, or emulsion comprising, consisting essentially of, or consisting of a treatment material, where the treatment liquid is capable of flowing from the interior volume 121 of elution device 120 through outlet 122. The treatment liquid flows from the interior volume 121 of the elution device 120 through outlet 122 and through tube 125*a* or valve 125*b* at a rate that is facilitated by gravity, in some cases further assisted by the vacuum created by the flow of produced fluid side stream 10' through side stream tubing 110 as it proceeds past outlet 122 and towards second end 112.

The treatment liquid is contacted with side stream 10' within or proximal to tube 125*a* or valve 125*b* as the treatment liquid flows from outlet 122, to provide an eluting contact between the treatment liquid and the produced fluid. The eluting contact results in dissolution or dispersion of the treatment liquid in the produced fluid of side stream 10', forming a treated side stream 11.

Valve 125*b* is capable of being adjusted to provide a metered or controlled flow of treatment liquid from the interior volume 121 of elution device 120, and accordingly to provide the treatment material at a controlled rate to the produced fluid flowing through side stream tubing 110. The rate of flow of produced fluid through the side stream tubing 110 may be further adjusted the via control of valves 112, 114 to affect the amount of treatment liquid eluted into the produced fluid.

A third elution assemblage 125 operable in the passive elution system 100 of FIG. 1 comprises, consists essentially of, or consists of a basket 125*c* affixed to elution device 120 beneath outlet 122, wherein basket 125*c* is designed and adapted to receive and hold a solid falling from outlet 122. The basket 125*c* extends downward from outlet 122 to protrude partially or completely into side stream tubing 110 to provide eluting contact between the treatment material and side stream 10'. Accordingly, in embodiments where the elution assemblage 125 of FIG. 1 is basket 125*c*, the treatment material present in the interior volume 121 of elution device 120 is characterized as a treatment solid.

In embodiments, a treatment solid is a monolithic article, an agglomerated collection of particles or pellets, a dispersion, a gel, a paste, an emulsion, or mixture or composite of two or more thereof that comprises, consists essentially of, or consists of a treatment material, and is incapable of liquid flow. Composite treatment solids include discrete particles, capsules, or pods having at least one solid material present on the surface thereof and one or more liquids, solutions, dispersions, gels, pastes, emulsions, or additional solids incorporated therein. A composite treatment may include e.g. a liquid, gel paste etc. capable of liquid flow; however, the particles, capsules or pods overall are not capable of liquid flow.

Thus, in some embodiments of third elution assemblage 125 of the passive elution system 100 of FIG. 1, a treatment material 130 is a discrete treatment solid item that is dispensed from the interior volume 121 of elution device 120 through outlet 122 and into basket 125*c* under force of gravity, where the discrete treatment solid item is contacted with side stream 10' flowing through the basket 125*c* that protrudes partially or completely into side stream tubing 110 in an eluting contact. The eluting contact results in elution of the discrete treatment solid item into the produced fluid of side stream 10', forming a treated side stream 11. As the discrete treatment solid item elutes from the basket 125*c*, one or more additional discrete treatment solid items present in the interior volume 121 of elution device 120 may shift or fall downward from outlet 122 and into basket 125*c* to continue the eluting contact.

In such embodiments, it will be appreciated by one of skill that the configuration and arrangement of elution device interior volume 121, outlet 122, and of basket 125*c* are designed and adapted to operate together to provide for the delivery of one or more discrete solid forms to the basket 125*c*; and to provide eluting contact between the discrete solid form(s) and the produced fluid of side stream 10'. Stated differently, the operator may select the configuration and arrangement of elution device interior volume 121, outlet 122, and basket 125*c* to accommodate a selected shape and size of a discrete treatment solid item, in order to promote predictable and repeatable dispensation of the solid form from the interior volume 121, through outlet 122, and into basket 125*c*; and further to promote a predictable rate of elution of the discrete treatment solid item in the flow of produced fluid.

Accordingly, the operator may adjust a rate of flow of produced fluid through side stream tubing 110 via control of valves 112, 114 to affect the amount of treatment solid eluted from basket 125*c*, or the amount of treated produced fluid dispensed into the wellbore. The operator may further adjust the solubility of the treatment solid, or a component thereof, or the concentration of one or more treatment materials in the treatment solid, thereby affecting the amount of treatment material eluted per unit of volume of produced fluid contacting the basket 125*c*.

One or more additional features of the passive elution system of first embodiments are optionally employed in conjunction with any of the foregoing features and embodiments described above. Additional features relating to the passive elution system of first embodiments are described after Second Embodiments below.

Second Embodiments

In second embodiments of the passive elution systems herein, the elution device comprises, consists essentially of, or consists of a containment defining an interior volume, the interior volume comprising a treatment material; an inlet; and an outlet. The elution device inlet is in fluid communication with a first conduit configured to provide a produced fluid flow through the inlet of the elution device and into the interior volume thereof to obtain eluting contact of the produced fluid with the treatment material inside the interior volume of the elution device and form a treated produced fluid. The treated produced fluid is directed through the outlet of the elution device by force of gravity, and enters a second conduit configured to direct a flow of treated produced fluid from the outlet to a wellbore of the subterranean reservoir from which the produced water was obtained.

Accordingly, in second embodiments herein, upon establishing fluid communication between the first conduit and a produced fluid flow, the flow of produced fluid is received by the first conduit and is directed toward the inlet of the elution device; the produced fluid contacts the treatment material inside the interior volume of the elution device to form a treated produced fluid; and the treated produced fluid is directed through the outlet of the elution device to a second conduit, where the flow of treated produced fluid is directed into a wellbore of the subterranean reservoir.

In second embodiments of the elution device herein, upon establishing fluid communication between the first conduit and a side stream flow of produced fluid from a subterranean reservoir, produced fluid flows into the first conduit, through the inlet of the elution device and into the interior volume of the elution device, where it contacts the treatment material to form a treated produced fluid. The treated produced fluid flows from the elution device through the outlet and into the second conduit, and the second conduit directs the treated produced fluid flow into a wellbore of the subterranean reservoir.

Figure 2:
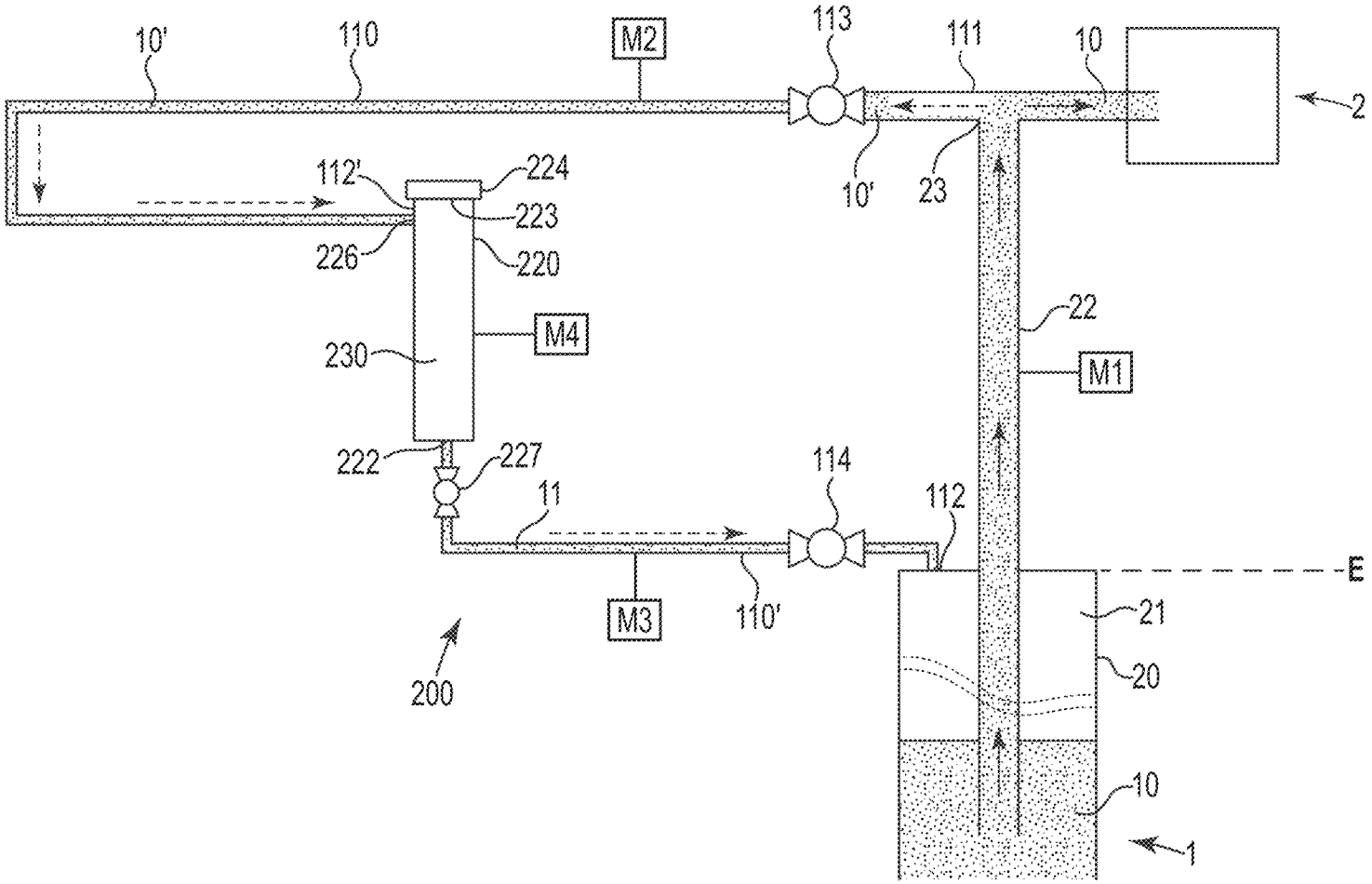
FIG. 2 is a diagram of a passive elution system of second embodiments herein.

FIG. 2 shows one example of a passive elution system of second embodiments, wherein same or similar numbers as to between FIG. 1 and FIG. 2 show the same or similar elements or functions. In FIG. 2, passive elution system 200 is fluidly connected to producing wellbore 1 at side stream takeoff 23 of production tubing 22, to provide a side stream of produced fluid 10' to side stream tubing 110 at first end 111 thereof. As shown in FIG. 2, side stream valve 113 is disposed between side stream takeoff 23 and side stream tubing 110 first end 111 to provide an adjusted flow of side stream 10'. In other second embodiments of the passive elution system similar the passive elution system 200 of FIG. 2, there is no side stream valve disposed between side stream takeoff 23 and first end 111 of side stream tubing 110.

Further as shown in FIG. 2, elution device 220 is a containment defining an interior volume 221 having an inlet 226 and an outlet 222 thereto, and a treatment material 230 disposed within interior volume 221. In embodiments, the general shape and features of the elution device are otherwise generally as shown in FIG. 1 and described in first embodiments above. Inlet 226 is in fluid communication with side stream tubing 110 at second end 112' thereof and is configured and adapted to receive side stream 10' and direct side stream 10' through inlet 126 and into interior volume 121 of elution device 120'. Side stream 10' obtains eluting contact with treatment material 230 within interior volume 221 to form a treated side stream 11. Treated side stream 11 flows through outlet 222 by force of gravity and is received by treated side stream tubing 110' at first end 111' thereof. In embodiments, side stream tubing 110 and treated side stream tubing 110' are made of the same material and/or have the same inner diameter; however, in other embodiments, side stream tubing 110 and treated side stream tubing 110' are made of different materials and/or have different inner diameters, as selected by the operator. Treated side stream 11 flows through treated side stream tubing 110' from first end 111' toward second end 112 in the direction indicated by dashed arrows in FIG. 2. Second end 112 of treated side stream tubing 110' is located proximal to or within producing wellbore 1 and arranged to dispense treated side stream 11 into the well annulus 21 defined by the well casing 20.

Further as shown in FIG. 2, elution device 220 is designed and configured to provide an eluting contact of produced fluid side stream 10' with treatment material 230, where the eluting contact is obtained within interior volume 221. Accordingly, FIG. 2 shows a configuration of elution device 220 where inlet 226 is defined at or near the gravitational top of elution device 220 during operation of passive elution system 200 and/or when elution device 220 is mounted on a support; and outlet 222 is defined at or near the gravitational bottom of elution device 220 during operation of passive elution system 200 and/or when elution device 220 is mounted on a support. Accordingly, during operation of the passive elution system 200 of FIG. 2, produced fluid side stream 10' enters interior volume 221 through inlet 226 and flows downward toward outlet 222, contacting treatment material 230 during and/or after the downward flow to form treated side stream 11; treated side stream 11 flows from outlet 222 into treated side stream tubing 110' at first end 111' thereof.

Additionally in the passive elution system 200 of FIG. 2, outlet valve 227 is disposed between outlet 222 of elution device 220 and second end 112 of treated side stream tubing 110', such as between outlet 222 of elution device 220 and dispensing valve 114. Outlet valve 227 is configured to regulate or control the flow of treated side stream 11 from outlet 222 by opening, closing, or partially obstructing the flow of treated side stream 11 as it proceeds through outlet 222 and into treated side stream tubing 110'. In other second embodiments of the passive elution system similar to the system of FIG. 2, there is no outlet valve disposed between outlet 122 of elution device 220 and second end 112 of treated side stream tubing 110'.

Additionally in the passive elution system 200 of FIG. 2, dispensing valve 114 is disposed between outlet 122 and second end 112 of treated side stream tubing 110' and is configured to regulate or control the flow of the dispensing of treated side stream 11 from second end 112 by opening, closing, or partially obstructing the flow of treated side stream 11 as it proceeds toward second end 112. Further, side stream valve 113 and dispensing valve 114 may both be manipulated independently or in concert to stop, start, increase, or decrease overall flow rate within side stream tubing 110, treated side stream tubing 110', or both. In other second embodiments of the passive elution system similar to the system of FIG. 2, there is no dispensing valve 114 disposed between outlet 222 and second end 112 of treated side stream tubing 110'. In some such embodiments, there is also no side stream valve 113; that is, in embodiments as selected by the operator, passive elution system 200 may include a side stream valve, a dispensing valve, both a side stream valve and a dispensing valve, or neither a side stream valve nor a dispensing valve.

In some second embodiments of the passive elution system similar to the system of FIG. 2, interior volume 221 of elution device 220 includes a monitoring device to monitor a volume, weight, or level of treated side stream 11 present in interior volume 221, further wherein the monitoring device is in signaling communication with a controller that controls side stream valve 113, such that when the monitoring device signals that a selected volume, weight, or level of fluid is reached in interior volume 221, the controller causes side stream valve 113 to close, thereby stopping the flow of side stream 10' into the elution device. Alternatively, the controller controls a different valve located upstream from inlet 226, such as between side stream tubing 110 first end 111 and inlet 226, to stop the flow of side stream 10' into elution device.

Additionally in the passive elution system 200 of FIG. 2, elution device 220 further defines access opening 223 to the interior volume 221 thereof, and a removable cap 224 that is designed and arranged to cover opening 223. In some embodiments cap 224 is designed and arranged to seal interior volume 221 from the surrounding atmosphere and/or prevent pressure equilibration of the interior volume 221 with the environment external to passive elution system 200 during operation thereof. Access opening 223 provides access to interior volume 221 of elution device 220 for addition of replacement treatment material, cleaning, and/or other interventions. In other second embodiments of the passive elution system similar to the system of FIG. 2, elution device 220 has no access opening or cap; in such embodiments elution device 220' is a single-use cartridge that is pre-loaded with a treatment material 230 and is capable of being removably attached to side stream tubing 110 and treated side stream tubing 110' to provide eluting contact with side stream 10'. In some such embodiments, the single-use cartridges may be returned to the supplier after the pre-loaded treatment material is depleted from the interior volume thereof due to eluting contact as described herein. In embodiments, the single-use cartridges are refilled by the supplier or recycled.

In some second embodiments of the passive elution system similar to the system of FIG. 2, second end 112 of treated side stream tubing 110' is appended with one or more additional fittings for controlling the flow of treated produced fluid to the wellbore, such as directional flow or spray nozzle fittings; a weighted fitting attached to treated side stream tubing 110' proximal to second end 112 thereof in order to maintain weighted placement of second end 112 disposed within well annulus 21; and/or one or more fittings affixing treated side stream tubing 110' to the well casing 20 near second end 112, for example clamps, clips, braces, brackets, and/or other fittings to mechanically affix, secure, or fasten treated side stream tubing 110' to well casing 20 to maintain a consistent location of dispensing.

In other second embodiments of the passive elution system similar to the system of FIG. 2, elution device 220*a* (not shown in FIG. 2) is similar to the passive elution device 220 of FIG. 2, except that inlet 226 is defined by cap 224, further where cap 224 is situated at or near the gravitational top of elution device 220*a* during operation of passive elution system 200 and/or when elution device 220*a* is mounted on a support. Further, elution device 220*a* is appended by a shut-off valve designed and adapted to stop the flow of side stream 10' through inlet 226. In some such embodiments, the shut-off valve is a float valve, wherein the float is extended into the interior volume 221 of the elution device 220*a* and operably connected to the shut-off valve to stop the flow of side stream 10' through inlet 226 at a selected float level. In such embodiments, passive elution system 200 further includes outlet valve 227. Accordingly, outlet valve 227 is closed when the shut-off valve is open, so that the interior volume 221 fills with side stream 10', forming treated side stream 11 during the filling. When the interior volume is filled to the selected level, the float valve acts to close the shut-off valve.

In other second embodiments, elution device 220*b* (not shown in FIG. 2) is similar to the passive elution device 220 of FIG. 2 except that a siphon arm, of similar shape and configuration to the siphon arm of a Soxhlet extractor, is situated between outlet 222 and treated side stream tubing 110'. In embodiments where passive elution device 220*b* is used, passive elution system 200 typically excludes outlet valve 227. The disposition of the siphon arm causes side stream 10' to enter inlet 226 and fill or substantially fill interior volume 221 of passive elution device 220*b*, and also causes eluting contact of produced fluid side stream 10' with treatment material 230 therein to form a treated side stream 11. When the volume of treated side stream 11 inside interior volume 221 of passive elution device 220*b* causes the level of treated side stream 11 to pass the top of the siphon arm, the entirety of the volume of treated side stream 11 present in interior volume 221 of elution device 220*b* is dispensed from outlet 222 in a single "batch", where it is received by treated side stream tubing 110' at first end 111'. Accordingly, the height of the siphon arm can be selected by the operator to provide a lower or higher fill level within interior volume 221 of the passive elution device 220*b*.

In still other second embodiments, elution device 220*c* is similar to the elution device 220 of FIG. 2 except that inlet 226 is defined at or near the gravitational bottom of elution device 220 during operation of passive elution system 200 and/or when elution device 220*c* is mounted on a support; and outlet 222 is defined at or near the gravitational top of elution device 220*c* during operation of passive elution system 200 and/or when elution device 220*c* is mounted on a support. In such embodiments, passive elution system 200 typically excludes outlet valve 227. In such embodiments, pressure provided by the flow of produced fluid side stream 10' causes side stream 10' to enter inlet 226 and fill or substantially fill interior volume 221 of elution device 220*c*, which in turn causes eluting contact of produced fluid side stream 10' with treatment material 230 to form a treated side stream 11. When the volume of treated side stream 11 inside interior volume 221 causes the level of treated side stream 11 to reach outlet 222, the treated side stream 11 begins to flow from outlet 222 and is received by treated side stream tubing 110' at first end 111'; and such flow continues in a direction generally from the bottom toward the top of elution device 220*c*.

In still other second embodiments, elution device 220*d* (not shown in FIG. 2) is similar to elution device 220 above of FIG. 2 described above except that elution device 220*d* includes outlet 222 defined between the gravitational top and bottom of elution device 220*d*, and below inlet 226 during operation of passive elution system 200 and/or when elution device 220*d* is mounted on a support. In such embodiments, side stream 10' enters inlet 226 to fill or substantially fill interior volume 221 of elution device 220*d*, which in turn causes eluting contact of produced fluid side stream 10' with treatment material 230 to form a treated side stream 11. When the volume of treated side stream 11 inside interior volume 221 causes the level of treated side stream 11 to reach outlet 222, the treated side stream 11 begins to flow from outlet 222 and is received by treated side stream tubing 110' at first end 111', and thereafter may provide a continuous eluting contact during the flow during flow of side stream 10'. Accordingly, in such embodiments, the height of outlet 222 can be selected by the operator to provide a lower or higher fill level within interior volume 221 of the passive elution device 220*d*. In some embodiments, passive elution system 200 excludes outlet valve 227. In some embodiments of the foregoing, inlet 226 of elution device 220*d* is configured similarly to inlet 226 of elution device 220*a*, that is, inlet 226 of elution device 220*a* is defined by cap 224.

In embodiments, any of the elution devices described herein, such as elution devices 120 of FIG. 1 and 220 of FIG. 2, and including elution devices 220*a*, 220*b*, 220*c*, or 220*d* include an interior volume 221 that is designed and adapted to provide eluting contact with a solid, liquid, or composite treatment material and accommodate an amount of the treatment material sufficient to carry out the intended treatment for the intended period of time. Thus, in one exemplary and nonlimiting example, an elution device in accordance with 220*d* of FIG. 2 is provided. The exemplary elution device has an interior volume described as cylindrical, wherein the interior cylindrical volume of the exemplary elution device is described as having a radius about 10 cm and a height of about 60 cm. Further, consistent with embodiment 220*d*, inlet 226 of the exemplary elution device is defined about 5 cm from the top of the device; and outlet 222 is defined about 15 cm beneath the inlet; that is, outlet 222 is situated between inlet 226 and the bottom of the interior volume of elution device 220*d*. Accordingly, the interior volume of the exemplary elution device may be filled to a level about 40 cm high, and obtain about 12.5 liters of fluid volume therein before a treated side stream begins to flow from outlet 222.

In order to combine case of use of the passive elution systems of first and second embodiments with the ability to deliver a sufficient amount of treatment material to obtain effective treatment of the completion string of a producing wellbore, we have found that the elution device may be selected to obtain interior dimensions of height of about 20 cm to 200 cm, such as 50 cm to 200 cm, 100 cm to 200 cm, 20 cm to 150 cm, 20 cm to 100 cm, 20 cm to 50 cm, 50 cm to 100 cm, 100 cm to 150 cm, 150 cm to 200 cm, 100 cm to 110 cm, 110 cm to 120 cm, 120 cm to 130 cm, 130 cm to 140 cm, 140 cm to 150 cm, 150 cm to 160 cm, 160 cm to 170 cm, 170 cm to 180 cm, 180 cm to 190 cm, or 190 cm to 200 cm; and an inner diameter (where generally cylindrical in shape) of about 5 cm to 100 cm, such as 10 cm to 100 cm, 15 cm to 100 cm, 20 cm to 100 cm, 25 cm to 100 cm, 30 cm to 100 cm, 35 cm to 100 cm, 40 cm to 100 cm, 45 cm to 100 cm, 50 cm to 100 cm, 60 cm to 100 cm, 70 cm to 100 cm, 80 cm to 100 cm, 90 cm to 100 cm, 5 cm to 90 cm, 5 cm to 80 cm, 5 cm to 70 cm, 5 cm to 60 cm, 5 cm to 50 cm, 5 cm to 45 cm, 5 cm to 40 cm, 5 cm to 35 cm, 5 cm to 30 cm, 5 cm to 25 cm, 5 cm to 20 cm, 5 cm to 15 cm, 5 cm to 10 cm, 10 cm to 15 cm, 15 cm to 20 cm, 20 cm to 25 cm, 25 cm to 30 cm, 30 cm to 35 cm, 35 cm to 40 cm, 40 cm to 50 cm, 50 cm to 55 cm, 55 cm, to 60 cm, 60 cm to 65 cm, 65 cm to 70 cm, 70 cm to 75 cm, 75 cm to 80 cm, 80 cm to 85 cm, 85 cm to 90 cm, 90 cm to 95 cm, or 95 cm to 100 cm. Accordingly, the interior volume of the elution device of the passive elution systems of first and second embodiments may be selected to obtain a total volume of about 1 liter to 6000 liters.

Third Embodiments

In third embodiments herein, the elution devices of first and second embodiments further comprise a treatment material. Treatment materials useful in connection with any one or more of the elution devices of the first and second embodiments include any one or more materials conventionally employed in batch or continuous treatments of fluid produced by subterranean reservoirs. Treatment materials thus include pH adjustment agents, antifreeze agents, corrosion inhibitors, purifiers, softeners, paraffin inhibitors, antiscale agents, biocides, fungicides, stabilizers, emulsifiers, hydrotropes, emulsion breakers, antifouling compounds, coagulants, flocculants, chelating agents, oxygen scavengers, rheology control agents, surfactants, foamers, defoamers, foam inhibitors, hydrate inhibitors, dispersants, asphaltene inhibitors, sulfide inhibitors, drag reducing agents, flow improvers, viscosity reducers, and the like.

Additionally in third embodiments, a treatment material may include a fluorescent material for tracing one or more treatment materials eluted into the produced fluid using the passive elution systems as described herein above. Tracing of treatment materials using fluorescent materials is described below in connection with controllers and measurement modules optionally combined any of the passive elution systems described herein. Accordingly, in embodiments, a fluorescent material is reacted with a treatment material, or combined with a treatment material in a mixture or blend to provide a fluorescent treatment material useful for tracing in any of the passive elution systems described herein.

In third embodiments herein, treatment materials useful in connection with any one or more of the elution devices of the foregoing embodiments include, but are not limited to one or more of the following. It will be appreciated that each of the following materials may be incorporated individually or combined in one or more treatment liquids, treatment solids, or composite treatment solids for disposing in the interior volume of an elution device of the passive elution systems of first and second embodiments.

Corrosion inhibitors. Corrosion inhibitors include, but are not limited to, mercaptoethanol, thioglycolic acid, sodium thiosulfate, imidazolines functionalized with fatty acid groups, alkylated cyclic amines such as imidazolines, triazoles, pyridines, pyrimidines, triazines, and the like, quaternary ammonium adducts of alkyl, aromatic, or mixed alkyl and aromatic hydrocarbons, phosphate esters of polyethylene oxide and the like.

Paraffin inhibitors. Paraffin inhibitors are polymeric compounds including, but not limited to, ethylene-vinyl acetate copolymers, alkylphenol-formaldehyde copolymers, acrylate and/or methacrylate (co) polymers, and copolymers comprising the residues of one or more alpha olefin monomers and a maleic anhydride monomer, the one or more alpha olefin monomers having the formula (I):

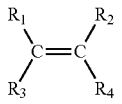

(I)

wherein $R_1$, $R_2$, $R_3$, and $R_4$ are independently selected from hydrogen and $C_5$-$C_{60}$ alkyl, with the proviso that at least two thereof are hydrogen; the alkyl maleic anhydride monomer having the formula (II):

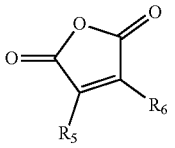

(II)

wherein $R_5$ and $R_6$ are independently selected from hydrogen or $C_1$-$C_{30}$ alkyl. In some embodiments, the maleic anhydride residue is further reacted with about 0.01 to 2.0 equivalents of a $C_{12}$-$C_{60}$ alkanol or amine per equivalent of anhydride.

Scale inhibitor compounds. Scaling is the term used to describe the hard surface coating of calcium carbonate, magnesium carbonate, and byproducts thereof that forms on metallic surfaces within metal containments carrying industrial water sources with high total dissolved solids, such as produced water, brackish water, sea water, and other sources of divalent carbonates. Scale inhibitor agents include, but are not limited to, oligomeric and polymeric compounds with borate, carboxylate, phosphate, sulfonate, or another anionic moiety.

pH adjustment compounds. Agents employed to adjust pH of one or more industrial water sources include but are not limited to Bronsted acids, conjugate bases and salts thereof and mixtures thereof to provide a selected pH for the industrial water source to be treated. The acids may be strong acids, that is, acids having a pKa of less than about 4; and weak acids, that is, acids having a pKa of about 4 or greater. In some embodiments, organic acids are weak acids. The pH adjustment agents are employed to adjust the pH of the industrial water source to a selected value or range thereof, which may be anywhere from pH of about 1 to 12 depending on the specific treatments to be carried out.

Antifreeze compounds. Antifreeze agents include, but are not limited to, compounds that are fully miscible with water and tend to lower the freezing temperature of the resulting mixture to below 0° C. and as low as −60° C. Such compounds include, for example, $C_1$-$C_3$ alkanols, $C_3$-$C_6$ ketones, $C_2$-$C_6$ glycols, water miscible sugar alcohols such as glycerol and erythritol as well as acetylated adducts thereof including triacetin, $C_3$-$C_{10}$ glycol ethers, and mixtures of such compounds.

Emulsion breaker compounds. Emulsion breakers include, but are not limited to, mixtures of one or more surfactants, water miscible solvents, and/or polymers that tend to resolve crude oil phases emulsified in industrial water sources such as are commonly experienced in the recovery of crude oil from subterranean reservoirs when the crude oil product is contacted with e.g. wash water to remove water soluble impurities from the oil. Surfactants and water miscible solvents are described elsewhere herein as treatment compounds. Polymers employed as emulsion breakers include polyalkylene oxide homopolymers and copolymers, polyethylencimines and functionalized versions thereof, and crosslinked versions of such polymers in addition to other types of non-ionic water dispersible polymers. Other emulsion breaking compounds are cationic oligomers and polymers having quaternary ammonium functionality Antifouling compounds. Antifouling compounds include, but are not limited to, copolymers of unsaturated fatty acids, primary diamines, and acrylic acid; copolymers of methacrylamidopropyl trimethylammonium chloride with acrylic acid and/or acrylamide; copolymers of ethylene glycol and propylene glycol; and blends of two or more thereof.

Coagulant compounds. Coagulants include, but are not limited to, treatment compounds used in solid-liquid separation stage to neutralize charges of suspended solids/particles so that they can agglomerate. Coagulants are categorized as inorganic coagulants, organic coagulants, and blends of inorganic and organic coagulants. Inorganic coagulants include, but are not limited to, aluminum or iron salts, such as aluminum sulfate/choride, ferric chloride/sulfate, polyaluminum chloride, and/or aluminum chloride hydrate. Organic coagulants include, but are not limited to, positively charged polymeric compounds with low molecular weight, including but not limited to polyamines, polyquaternized polymers, polyDADMAC, Epi-DMA, and coagulants recited in *Kirk-Othmer Encyclopedia of Chemical Technology,* 5th Edition, (2005), (Published by Wiley, John & Sons, Inc.).

Surfactant compounds. Surfactants include anionic, nonionic, cationic, and zwitterionic surfactants that reduce the interfacial tension of water when added thereto. The type or use of surfactants is not limited. In some embodiments a surfactant is a polymeric surfactant. Enabling descriptions of surfactants are stated in *Kirk-Othmer, Encyclopedia of Chemical Technology*, Third Edition, volume 8, pages 900-912, and in *Mccutcheon's Emulsifiers and Detergents*, both of which are incorporated herein by reference in their entirety and for all purposes.

Flocculant compounds. Flocculants include, but are not limited to, compositions of matter which when added to an industrial water source within which certain particles are thermodynamically inclined to disperse, induces agglomerations of those particles to form as a result of weak physical forces such as surface tension and adsorption. Flocculation often involves the formation of discrete globules of particles aggregated together with films of liquid carrier interposed between the aggregated globules, as used herein flocculation includes those descriptions recited in ASTME 20-85 as well as those recited in *Kirk-Othmer Encyclopedia of Chemical Technology,* 5th Edition, (2005), (Published by Wiley, John & Sons, Inc.), both of which are incorporated herein by reference in their entirety and for all purposes.

Chelating compounds. Chelating agents include, but are not limited to, compounds that are effective to reduce or remove one or more metal ions from an industrial water source. Chelation involves the formation or presence of two or more separate coordinate bonds between a polydentate (multiple bonded) ligand and a single central atom. Usually these ligands are organic compounds, and are called chelants, chelators, chelating agents, or sequestering agents.

Antimicrobial compounds. Antimicrobial compounds include, but are not limited to, compounds with a microbiostatic, disinfectant, or sterilization effect on the industrial water source when added thereto. Nonlimiting examples of antimicrobials include bactericides, fungicides, nematicides, and the like. Bactericides include active chlorine disinfectants, e.g. including hypochlorites, chlorine dioxide, and the like; phenols such as triclosan, phenol itself, thymol, and the like; cationic surfactants such as quaternary ammonium surfactants, chlorhexidine, and the like; ozone, permanganates, colloidal silver, silver nitrate, copper based compounds, iodine preparations, peroxides, and strong acids and strong alkalis wherein the water source is caused to have a pH of greater than about 12 or less than about 1. Fungicides include, but are not limited to, strobilurins such as azoxystrobin, trifloxystrobin and pyraclostrobin; triazoles and anilino-pyrimidines such as tebuconazole, cyproconazole, triadimefon, pyrimethanil; and additionally compounds such as triadimefon, benomyl, captan, chlorothalonil, copper sulfate, cyproconazole, dodine, flusilazole, flutolanil, fosetyl-al, gallex, mancozeb, metalaxyl, prochloraz, propiconazole, tebuconazole, thiophanate methyl, triadimenol, tridimefon, triphenyltin hydroxide, ziram, and the like.

Hydrate inhibitors. Hydrate inhibitors include both kinetic hydrate inhibitors and anti-agglomerants. Kinetic hydrate inhibitors include hydroxyethylcellulose; alkyl glycosides; polymers having N-functional cyclic moieties and/or amide moieties attached to a hydrophobic group present within one or more repeat units thereof, including polyvinyllactams such as polyvinylpyrrolidone and related polymers, amine polyalkoxylates, and polydialkylacrylamides; and combinations of any of the foregoing with synergists including polyelectrolytes, polyether block copolymers, polyalkylacrylamides, and polyalkyloxazolines; quaternary ammonium surfactants, clathrates thereof, and combinations of these with one or more polymers having N-functional cyclic moieties and/or amide moieties attached to a hydrophobic group present within one or more repeat units thereof. Anti-agglomerants include surfactants that provide emulsions of hydrates confined within the water droplets, preventing agglomeration. Exemplary surfactants include diethanolamides, dioctylsulfosuccinates, sorbitans, ethoxylated polyols, ethoxylated fatty acids, ethoxylated amines, and polymeric surfactants based on polyalkenyl succinic anhydride.

Sulfide inhibitors. Sulfide inhibitors include aromatic amino compounds known to scavenge hydrogen sulfide gas from one or more waste streams. Compounds such as triazine and related compounds such as HMTA (hexamethylenetetraamine, or 1,3,5,7-tetraazatricyclo[3.3.1.13,7]decane) are useful as sulfide inhibitors.

A treatment material disposed in the interior volume of an elution device of first or second embodiments is further provided in a form that is suitable for use in the selected design of the associated passive elution system and also suitable for use within the interior volume of the elution device. In some embodiments, the treatment material is a treatment liquid. In other embodiments, the treatment material is a treatment solid.

For example, in one exemplary but non-limiting embodiment of FIG. 1, treatment material 130 present in the interior volume 121 of elution device 120 is a treatment liquid. A treatment liquid is a solution, dispersion, gel, paste, or emulsion comprising, consisting essentially of, or consisting of a treatment material or mixture thereof, where the treatment liquid is capable of liquid flow from the interior volume 121 of elution device 120 through outlet 122. In any one or more embodiments of the passive elution systems 100, 200 and elution devices 120, 220 described herein, including elution assemblages 125*a* and 125*b*, the treatment material is a treatment liquid as selected by the operator.

In another exemplary but non-limiting embodiment of FIG. 1, the treatment material 130 present in the interior volume 121 of elution device 120 is a treatment solid. A treatment solid is a monolithic article, an agglomerated collection of particles or pellets, a dispersion, a gel, a paste, an emulsion, or a mixture of two or more thereof that comprises, consists essentially of, or consists of a treatment material, wherein the treatment solid is incapable of liquid flow but is capable of eluting into a produced fluid. In any one or more embodiments of the passive elution systems 100, 200 and elution devices 120, 220 described herein, including elution assemblages 125*a*, 125*b*, and 125*c*, the treatment material is a treatment solid as selected by the operator.

In yet another exemplary but non-limiting embodiment of FIG. 1, the treatment material 130 present in the interior volume 121 of elution device 120 is a composite treatment solid. Composite treatment solids include discrete particles, capsules, or pods having at least one solid material present on the surface thereof and one or more liquids, solutions, dispersions, gels, pastes, emulsions, or additional solids incorporated therein. At least one component of a composite treatment solid is a treatment material, and in some embodiments each of the components of the composite treatment solid are individually treatment materials. A composite treatment solid may include e.g. a liquid, gel paste etc. capable of liquid flow; however, the particles, capsules or pods overall are not capable of liquid flow. A composite treatment solid may include two or more materials having differential solubility; for example, a liquid treatment material and a polymer pouch surrounding and enclosing the liquid treatment material, wherein the polymer pouch has a known solubility in a produced fluid, such that slow elution of the pouch material eventually causes the pouch to breach, resulting in the rapid release of the entire contents of the liquid treatment material from the pouch. In any one or more embodiments of the passive elution systems 100, 200 and elution devices 120, 220 described herein, including elution assemblages 125*a*, 125*b*, and 125*c*, the treatment material is a composite treatment solid as selected by the operator.

In an exemplary but non-limiting embodiment of FIG. 2, the treatment material is a liquid, a solid, or a composite solid. In some such embodiments, elution device 220 of FIG. 2, including elution device embodiments 220*a*, 220*b*, 220*c*, 220*d* described above have or include a treatment solid or composite treatment solid disposed in the interior thereof.

In some third embodiments, a composite treatment solid is a tablet or a sealed pouch or pod comprising a treatment material that is a combination of sodium bicarbonate, citric acid, and a corrosion inhibitor selected from 2-mercaptoethanol, an imidazoline, a phosphate ester, an alkyl pyridine, a tall oil fatty acid, triethylamine, or benzyl-(C12-C18 linear alkyl)-dimethyl-ammonium chloride, or a combination of two or more thereof. In pouch or pod embodiments, treatment material is contained within a pouch formed from a water-soluble polymer selected from cellulose, modified cellulose, starch, polyvinyl alcohol, polyvinylpyrrolidone, and combinations of two or more thereof.

In third embodiments where the treatment material is a treatment solid or a composite treatment solid, it will appreciated by one of skill that the configuration and arrangement of elution device interior volume, outlet therefrom, and other features of the passive elution systems of first and second embodiments are designed and adapted to operate together to provide for the eluting contact of one or more discrete solid forms with the produced fluid side stream. Accordingly, the operator may select the configuration and arrangement of an elution device interior volume, outlet, and other features to accommodate a selected shape and size of a discrete treatment solid item or composite treatment solid item, in order to promote predictable and repeatable rate of elution of the discrete treatment solid item in the flow of produced fluid.

Suitable passive elution systems comprising a treatment material and capable of providing a continuous stream of treated produced fluid include any of the passive elution systems as shown in FIG. 1 and generally described in accordance with first embodiments herein; and FIG. 2 elution devices 220, 220*c*, and 220*d*, further as described in accordance with second embodiments herein.

In some third embodiments, a passive elution system further comprising a treatment material provides a batch stream of treated produced fluid to the wellbore to form a batch-treated wellbore. In batch stream treatment embodiments, continuous operation of the passive elution system causes periodic, or batch, formation of treated produced fluid, that is, a batch stream of treated produced fluid; wherein the periodic batch stream of produced fluid is directed to the wellbore to form a batch-treated wellbore. Passive elution systems designed and adapted to providing a batch stream of treated produced fluid include in particular elution devices 220*a* and 220*b* of FIG. 2.

In third embodiments, any one of the passive elution systems of first and second embodiments are capable of and suitable for delivery of a batch stream of treated produced fluid by use of a composite treatment solid as the treatment material. Accordingly, in embodiments of the passive elution systems 100, 200 and elution devices 120, 220 described herein, the treatment material is a composite treatment solid. As described above, composite treatment solids are discrete particles, capsules, or pods having at least one solid material present on the surface thereof, and one or more liquids, solutions, dispersions, gels, pastes, emulsions, or additional solids incorporated therein. Further, in embodiments, a composite treatment solid includes a liquid, gel, or paste that is capable of liquid flow; however, the composite treatment solid is itself not capable of liquid flow. Further, in embodiments, each of the components of a composite treatment solid are individually treatment materials. Further, in embodiments, a composite treatment solid includes two or more materials of different solubility in produced fluid.

Further, in embodiments, a composite treatment solid includes two or more materials having differential solubility in produced fluid.

In one exemplary embodiment of a composite treatment solid suitable for use in the passive elution systems of first and second embodiments herein, a composite treatment solid is a batch-release composite treatment solid. Batch-release composite treatment solids comprise, consist essentially of, or consist of a liquid treatment material and a polymer pouch surrounding and enclosing the liquid treatment material, wherein the polymer pouch has a known solubility in a produced fluid, such that elution of the polymer material causes the pouch to breach, resulting in the batch release of the entire contents of the liquid treatment material from the pouch. In any one or more embodiments of the passive elution systems of first and second embodiments, the treatment material is a batch-release composite treatment solid as selected by the operator.

In some third embodiments, a batch-release treatment includes a polymer for obtaining a coating on one or more surfaces of the production string. In yet another embodiment, a batch-release treatment includes a passivating compound for passivating one or more surfaces of the production string.

Fourth Embodiments

Fourth embodiments herein include methods of using the passive elution systems of third embodiments to treat a wellbore.

The passive elution systems of first and second embodiments, comprising an elution device that comprises a treatment material therein as described in third embodiments, are capable of operating to provide wellbore treatments by obtaining a flow of produced fluid that emanates above the surface of the earth, and dispensing a treated flow at or beneath the surface of the earth. Accordingly, in some fourth embodiments herein, where a side stream of produced fluid is obtained above the earth, a rate of flow of less than 1 liter per hour of produced fluid into the elution device of the passive elution system is sufficient to provide effective treatment of a wellbore. In one representative but non-limiting example employing the passive elution system of FIG. 2, a side stream of produced fluid 10' is dripped onto a treatment solid 230 disposed within interior volume 221 of elution device 220, and the eluting contact occurs as the dripped produced fluid flows toward outlet 222. In some such embodiments, outlet valve 227 is closed intermittently during operation of the passive elution system 200 to increase the period of the eluting contact.

In other fourth embodiments, where a side stream of produced fluid is obtained above the surface of the earth, a rate of treated fluid flow of greater than 1 liter per hour is sufficient to provide effective treatment of a wellbore. In some embodiments, the rate of flow of a side stream of produced fluid into the passive elution system is between 1 liter per hour and 10 liters per second, such as between 10 liters per hour and 10 liters per second, or 30 liters per hour and 10 liters per second, or 50 liters per hour and 10 liters per second, or 1 liter per minute and 10 liters per second, or 10 liters per minute and 10 liters per second, or 20 liters per minute and 10 liters per second, or 40 liters per minute and 10 liters per second, or 1 liter per second and 10 liters per second, or 5 liters per second and 10 liters per second, or 40 liters per minute and 10 liters per second, or 1 liter per hour and 5 liters per second, or 1 liter per hour and 1 liters per second, or 1 liter per hour and 50 liters per hour, or 1 liter per hour and 40 liters per hour, or or 1 liter per hour and 30 liters per hour, or 1 liter per hour and 20 liters per hour, or 1 liter per hour and 10 liters per hour, or 1 liter per hour and 5 liters per hour, or 1 liter per minute and 5 liters per minute, or 5 liters per minute and 10 liters per minute, or 10 liters per minute and 20 liters per minute, or or 20 liters per minute and 30 liters per minute, or 30 liters per minute and 40 liters per minute, or 40 liters per minute and 50 liters per minute, or 50 liters per minute and 1 liter per second, or 1 liter per second and 5 liters per second, or between 5 liters per second and 10 liters per second, or 100 liters per hour to about 3500 liters per hour.

In fourth embodiments, the one or more treatment materials of third embodiments herein are selected to provide an eluting contact with a flow of produced fluid obtained by the elution devices of first and second embodiments, to result in formation of a treated produced fluid, further wherein the treated produced fluid has a selected concentration or range of concentration of the treatment material during the operation of the passive elution systems of first and second embodiments as described herein. In some third embodiments, a passive elution system is configured to provide a continuous stream of treated produced fluid to a wellbore, to form a continuously treated wellbore. In such embodiments, the rate of elution of the treatment material provided by the eluting contact is adjusted to provide a treated produced fluid flow that includes about 0.1 ppm to about 10,000 ppm by weight (or by weight/volume (w/v) where specified) of a treatment material, that is, of treatment material solids (or "actives"), depending on the specific treatment material and type (corrosion inhibitor, scale inhibitor, etc.), for example 0.1 ppm to 10,000 ppm, or 1 ppm to 10,000 ppm, or 10 ppm to 10,000 ppm, or 50 ppm to 10,000 ppm, or 100 ppm to 10,000 ppm, or 200 ppm to 10,000 ppm, or 300 ppm to 10,000 ppm, or 400 ppm to 10,000 ppm, or 500 ppm to 10,000 ppm, or 600 ppm to 10,000 ppm, or 700 ppm to 10,000 ppm, or 800 ppm to 10,000 ppm, or 900 ppm to 10,000 ppm, or 1000 ppm to 10,000 ppm, or 1500 ppm to 10,000 ppm, or 2000 ppm to 10,000 ppm, or 3000 ppm to 10,000 ppm, or 4000 ppm to 10,000 ppm, or 5000 ppm to 10,000 ppm, or 6000 ppm to 10,000 ppm, or 7000 ppm to 10,000 ppm, or 8000 ppm to 10,000 ppm, or 9000 ppm to 10,000 ppm, or 1 ppm to 5000 ppm, or 10 ppm to 5000 ppm, or 50 ppm to 5000 ppm, or 100 ppm to 5000 ppm, or 200 ppm to 5000 ppm, or 300 ppm to 5000 ppm, or 400 ppm to 5000 ppm, or 500 ppm to 5000 ppm, or 600 ppm to 5000 ppm, or 700 ppm to 5000 ppm, or 800 ppm to 5000 ppm, or 900 ppm to 5000 ppm, or 1000 ppm to 5000 ppm, or 1500 ppm to 5000 ppm, or 2000 ppm to 5000 ppm, or 3000 ppm to 5000 ppm, or 4000 ppm to 5000 ppm, or 0.01 to 0.1 ppm, or 0.1 ppm to 1 ppm, or 1 ppm to 10 ppm, or 10 ppm to 50 ppm, or 50 ppm to 100 ppm, or 100 ppm to 200 ppm, or 200 ppm to 300 ppm, or 300 ppm to 400 ppm, or 400 ppm to 500 ppm, or 500 ppm to 600 ppm, or 700 ppm to 800 ppm, or 800 ppm to 900 ppm, or 900 ppm to 1000 ppm, or 1000 ppm to 1500 ppm, or 1500 ppm to 2000 ppm, or 2000 ppm to 2500 ppm, or 2500 ppm to 3000 ppm, or 3000 ppm to 3500 ppm, or 3500 ppm to 4000 ppm, or 4000 ppm to 4500 ppm, or 4500 ppm to 5000 ppm, or 5000 ppm to 5500 ppm, or 5500 ppm to 6000 ppm, or 6000 ppm to 6500 ppm, or 6500 ppm to 7000 ppm, or 7000 ppm to 7500 ppm, or 7500 ppm to 8000 ppm, or 8000 ppm to 8500 ppm, or 8500 ppm to 9000 ppm, or 9000 ppm to 9500 ppm, or 9500 ppm to 10,000 ppm by weight or w/v (where specified) of the treatment material solids or "actives".

In some fourth embodiments, a treated produced fluid flow includes about 1 ppm to about 1000 ppm by weight or w/v (where specified) of a corrosion inhibitor, that is, corrosion inhibitor solids (or "actives"), for example 1 ppm to 1000 ppm, or 5 ppm to 1000 ppm, or 10 ppm to 1000 ppm, or 20 ppm to 1000 ppm, or 50 ppm to 1000 ppm, or 100 ppm to 1000 ppm, or 150 ppm to 1000 ppm, or 200 ppm to 1000 ppm, or 300 ppm to 1000 ppm, or 400 ppm to 1000 ppm, or 500 ppm to 1000 ppm, or 600 ppm to 1000 ppm, or 700 ppm to 1000 ppm, or 800 ppm to 1000 ppm, or 900 ppm to 1000 ppm, or 0.01 ppm to 0.1 ppm, or 0.1 ppm to 1 ppm, or 1 ppm to 5 ppm, or 5 ppm to 10 ppm, or 10 ppm to 20 ppm, or 20 ppm to 30 ppm, or 30 ppm to 40 ppm, or 40 ppm to 50 ppm, or 50 ppm to 60 ppm, or 60 ppm to 70 ppm, or 70 ppm to 80 ppm, or 80 ppm to 90 ppm, or 90 ppm to 100 ppm, or 100 ppm to 150 ppm, or 150 ppm to 200 ppm, or 200 ppm to 250 ppm, or 250 ppm to 300 ppm, or 300 ppm to 350 ppm, or 350 ppm to 400 ppm, or 400 ppm to 450 ppm, or 450 ppm to 500 ppm, or 500 ppm to 600 ppm, or 600 ppm to 700 ppm, or 700 ppm to 800 ppm, or 800 ppm to 900 ppm, or 900 ppm to 1000 ppm.

In fourth embodiments, control of the rate of fluid flow into, through, or out of any of the passive elution systems described herein includes control of the rate of flow of the side stream of produced fluid into the passive elution system, control of the rate of flow during eluting contact of the produced fluid with a treatment material, or control of the rate of flow of treated produced fluid into the wellbore. In embodiments, the rate of flow of produced fluid into the passive elution system determines the rate of elution of the treatment material; and therefore a faster rate of flow of produced fluid during operation of the passive elution system obtains a greater volume of eluate in the same amount of time.

Accordingly, in some fourth embodiments, during operation of a passive elution system of any of the embodiments described herein, a rate of flow of produced fluid is obtained and an unmodified flow thereof is received directly by the passive elution system without modifying a flow rate thereof. In other embodiments, during operation of a passive elution system of any of the embodiments described herein, a first flow rate of produced fluid or treated produced fluid is modified to obtain a second flow rate of the produced fluid or treated produced fluid that is less than the first flow rate. In such embodiments, the second flow rate of the produced fluid or of the treated produced fluid, as determined by context, is a modified flow. In some such embodiments, the second flow rate is zero, that is, the modified flow is a stopped flow; and accordingly during operation of a passive elution system of any of the embodiments described herein, the flow of produced fluid applied to the passive elution system is stopped and started intermittently. In some embodiments, the second flow rate is between the first flow rate and a stopped flow. In some embodiments, a variable flow rate is received or directed by the passive elution system during operation thereof, wherein the variable flow rate varies between the first flow rate and a stopped flow. In some embodiments, the modified flow is both a variable flow and an intermittent flow.

Control of the rate of flow of a produced fluid into the passive elution system, and/or the flow of a treated produced fluid into a wellbore, is suitably provided by manipulating one or more valves placed in the fluid flow path of the passive elution system. Accordingly, in embodiments modified flows, including variable flows and intermittent flows, are obtained by operating one or more valves present along the fluid path between the point of the produced fluid side stream takeoff (from the production tube), and the point where the treated produced fluid is dispensed to treat the wellbore. Exemplary placement of valves to enable a modified flow within passive elution system 100 is shown in FIG. 1. Accordingly, stream valve 113, dispensing valve 114, and valve 125*a* are suitably opened, closed, or partially closed to provide intermittent, variable, or both intermittent and variable flow into, through, and from passive elution system 100, further as selected by the operator. Similarly, exemplary placement of valves to enable a modified flow within passive elution system 200 is shown in FIG. 2. Accordingly, side stream valve 113, dispensing valve 114, and outlet valve 227 are independently opened, closed, or partially closed to provide intermittent, variable, or both intermittent and variable flow into, through, and/or from passive elution system 200, as selected by the operator.

Manipulation of one or more valves present in a fluid path of any passive elution system as described herein is achieved by manual manipulation of controls, or by automated means such as a controller attached to a valve configured and adapted to open, close, or partially close the valve in response to a signal received from a timer or a measurement module. Accordingly, in some such embodiments, the controller is in signaling communication with a timer, and the timer communicates with the controller to open or close the valve to provide intermittent flow of produced fluid into the passive elution system, or into the elution device and/or into an eluting contact; and/or intermittent flow of treated produced fluid into a wellbore. In other such embodiments, the controller is in signaling communication with a timer, and the timer communicates with the controller to partially open or close a valve to provide intermittently modified flow of produced fluid into the passive elution system, or into the elution device and/or into an eluting contact; and/or intermittently modified flow of treated produced fluid into a wellbore. The timer cycle is set by the operator.

In other embodiments, manipulation of one or more valves present in a fluid path of a passive elution system as described herein is achieved by a controller in signaling communication with a measurement module, where the measurement module communicates a signal related to a measured value obtained by the measurement module to the controller, and the controller manipulates one or more valves in response to the measurement value signal. In some such embodiments, the manipulation of one or more valves in response to a measurement value signal provides intermittent flow of produced fluid into the passive elution system, or into the elution device and/or into an eluting contact; and/or intermittent flow of treated produced fluid into a wellbore. In other such embodiments, manipulation of one or more valves provides intermittently modified flow of produced fluid into the passive elution system, or into the elution device and/or into an eluting contact; and/or intermittently modified flow of treated produced fluid into a wellbore. Additionally, in embodiments, a measurement module provides a continuous measurement value signal to the controller, and the manipulation of the one or more valves present in the fluid path of the passive elution system is continuously variable over the range of 0% to 100% of the takeoff flow of produced fluid received into the passive elution system.

In some fourth embodiments, during operation of a passive elution system of any of the first to third embodiments described herein, measurement modules are operably located in one or more locations as indicated in FIGS. 1 and 2. In FIG. 1, measurement modules are placed in contact with a fluid flow, or in fluid connection with a fluid flow, at one or more of points M1, M2, M3, and M4, where point M1 is located along production tube 22; point M2 is located between side stream takeoff 23 and elution assemblage 125; point M3 is located between outlet 122 and second end 112 of side stream tubing 110; and point M4 is located on elution device 120. In FIG. 2, measurement modules are placed in contact with a fluid flow, or in fluid connection with a fluid flow, at one or more of points M1, M2, M3, and M4, where point M1 is located along production tube 22; point M2 is located between side stream takeoff 23 and inlet 226; point M3 is located between outlet 222 and second end 112 of side stream tubing 110'; and point M4 is located on elution device 220.

Suitable measurement modules placed in one or more locations M1, M2, M3, M4 include: pressure gauges, for measuring fluid pressure; tensiometers, for measuring surface tension of fluid; thermocouples, for measuring temperature values; pH meters, for measuring pH values; conductivity meters, for measuring conductivity values; turbidity meters, for measuring turbidity values; chemical sensing modules, for measuring a value related to a presence or a concentration of one or more treatment materials, corrodents, scale-producing compounds, gases such as $CO_2$ and/or $H_2S$, and the like; or fluorescence measurement modules, for irradiating the fluid stream and concomitantly measuring a fluorescence value. One or more such modules are suitably located at one or more points M1, M2, M3, and M4 without limitation, and as determined by the operator.

Placement of a measurement module at location M1 provides measurement of values related to a property of the produced fluid emanating from the reservoir, regardless of whether the passive elution system is operable, that is, whether or not the side stream of produced fluid is flowing through the passive elution system or the flow is shut off, such as in the case of an intermittent flow of produced fluid into the passive elution system. Accordingly, placement of a measurement module at location M1 enables the module to provide a signal to the controller related to one or more properties of the produced water flowing through the production string: that is, from the wellbore through the production tube toward a processing facility where it is processed to provide one or more useful hydrocarbon products. In response to the signal, the controller manipulates one or more valves present in the fluid path of the passive elution system to provide a rate of fluid flow that is between 0% and 100% of the takeoff flow of produced fluid received into the passive elution system.

Accordingly, in one exemplary but non-limiting fourth embodiment, a pH measurement module at location A measures a pH, and communicates a signal related to the pH of the production string flow to a controller adapted and disposed to control a side stream valve, such as side stream valve 113 in FIGS. 1 and 2; the controller responds to a pH of less than 7 by increasing the rate of the side stream flow entering the passive elution system, thereby increasing the flow toward the elution device and into eluting contact with a pH adjustment agent disposed within the eluting device; and increasing further the rate of flow of treated produced fluid into the wellbore. Further, in such embodiments, when the pH of the wellbore is raised above 7, the controller similarly responds to the signal from the pH measurement module to decrease the rate of the side stream flow entering the passive elution system.

Placement of a measurement module at location M2 provides measurement of values related to the produced fluid side stream present within the passive elution system. In embodiments, module location M2 provides for the measurement of the same values as location M1, except that measurements are suitably obtained only when the passive elution system is operable, that is, a flow is provided therein and is not shut off, as in an intermittent flow.

Placement of a measurement module at location M3 provides measurement of values related to a property of a treated produced fluid prior to the treated produced fluid being directed into the wellbore. Data from a measurement module placed at location M3 is communicated, in embodiments, to a controller that adjusts the rate of flow through the passive elution system in order to subsequently obtain the desired measured value. Accordingly, in one exemplary but non-limiting embodiment, a tensiometer module at location M3 measures a surface tension, and communicates a signal related to the surface tension of the production string flow to a controller adapted and disposed to control a side stream valve, such as side stream valve 113 in FIGS. 1 and 2; the controller responds to a selected surface tension value by increasing or decreasing the rate of the side stream flow entering the passive elution system, thereby increasing or decreasing the flow toward the elution device and into eluting contact with a treatment material disposed within the eluting device; and increasing further the rate of flow of treated produced fluid into the wellbore.

Placement of a measurement module at location M4 provides measurement of values related to a property of the contents of the elution device. In embodiments, module location M4 provides for the measurement of the same values as location M3, except that measurements are suitably obtained for material disposed within the elution device, that is, during eluting contact of a produced water with a treatment material disposed within or proximal to the interior volume of the elution device. In embodiments, placement of a measurement module at location M4 provides measurement of values such as fluid pressure or temperature within the elution device; in still other embodiments, placement of a measurement module at location M4 provides a means to determine changes in surface tension, pH, or turbidity indicating, for example, that a treatment material within the elution device is depleted, thereby notifying an operator that additional treatment material should be added to the elution device.

In some fourth embodiments, placement of a first measurement module in location M1 or M2; and placement of a second measurement module that measures the same value as the first measurement module in location M3 and/or M4 provides a feedback loop for controlling both the need to add a treatment material to the wellbore, and the rate at which the treatment material is dispensed to the wellbore. Such a feedback loop is of particular value in embodiments where the passive elution system provides a continuous stream of treated produced fluid to the wellbore to form a continuously treated wellbore. In such embodiments, the rate of elution of the treatment material provided by the eluting contact is adjusted by use of the feedback loop to provide a treated produced fluid flow that includes between 0.1 ppm and 10,000 ppm by weight of a treatment material, depending on the signals received by the controller.

In some embodiments, two or more controllers, timers, or different kinds of measurement modules are employed in connection with the manipulation of one or more valves present in a fluid path of a passive elution system as described herein, in order to provide the desired level of variable, continuous, and/or multi-value based control of a rate of flow within the passive elution systems as described herein. In some embodiments, one or more timers, controllers, or measurement modules are further attached to a source of power, such as AC/DC, battery, or solar cell power in order to obtain one or more measurement values, communicate one or more measurement values, and/or manipulate one or more valves.

Additionally, in any one of the foregoing fourth embodiments and further as noted above, a treatment material may include a fluorescent material for tracing one or more treatment materials eluted into a produced fluid by operation of the passive elution systems as described herein. In embodiments, the use of fluorescent materials, such as a fluorescent compound added to a treatment material or bonded to a treatment material ("tagged" treatment material), allows for the efficient treatment of a wellbore by providing a means to measure the amount of a treatment material present in a produced fluid, or in a treated produced fluid, continuously in real time. A treated produced fluid having a fluorescent treatment material eluted therein is irradiated with a wavelength of light known to cause a fluorescent emission of the fluorescent treatment material. The known fluorescence emission wavelength of the tracer is targeted for measurement.

Accordingly, in embodiments, a fluorescent material is reacted with a treatment material, or combined with a treatment material in a mixture or blend thereof to provide a fluorescent treatment material useful for eluting contact and subsequent tracing in any of the passive elution systems described herein. Such tracing is provided by situating a fluorescence measurement module at one or more locations M1, M2, M3, or M4, as described above, for irradiating the fluid stream and concomitantly measuring a fluorescence value of the fluorescent treatment material therein. The concentration of the treatment material in the produced fluid is thereby quantified, as is understood by one of skill, and the quantitative value is communicated to a controller to manipulate one or more valves present in the fluid path of a passive elution system as described herein, in order to provide the desired level of variable, continuous, and/or multi-value based control of a rate of flow within the passive elution system.

As discussed herein throughout, the passive elution systems herein do not require external or applied sources of power to obtain operability. That is, the passive elution systems operate by directing a fluid flow, and do not require external or applied sources of power to cause a fluid flow through the passive elution system. Stated differently, the passive elution systems do not require external or applied sources of power to obtain a wellbore treatment.

Instead, the passive elution systems are designed and configured to passively receive a produced fluid flow from a wellbore of a subterranean reservoir, direct the produced fluid flow into an eluting contact with a treatment material to form a treated produced fluid flow, and direct the treated produced fluid flow into the wellbore of the subterranean reservoir. In embodiments, the produced fluid flow is received at a point at or above the surface of the earth. In embodiments, the produced fluid flow is a side stream from a production tubing.

The passive elution systems herein are characterized as excluding external or additional sources of pressure or force to urge fluid flow therethrough, such as hydraulic pumps, peristaltic pumps, hand pumps, pneumatic pressure, or other sources of pressure or force. The passive elution systems are characterized as relying solely on a pressurized flow of produced fluid derived from a producing subterranean reservoir for operability, that is, to move produced fluid into the system and into contact with the elution device; and to move treated produced fluid from the elution device to the wellbore to provide a treated wellbore.

The passive elution systems herein obtain several benefits over conventional systems for treating production strings appended to subterranean reservoirs. The passive elution systems herein are easy to transport, set up for operability, disassemble and reassemble, use and reuse; in embodiments the entire passive elution system is transportable in a standard vehicle, such as in the trunk of a sedan. The passive elution systems herein are useful for continuous additions of treatment materials to a wellbore, or batch-type treatments, including polymer coating or passivating treatments intended to associate with an interior surface of the production string.

A further advantage of the passive elution systems herein is that either continuous or batch-type treatment may be followed by a period of no treatment: that is, a period of "flushing" produced fluid through the passive elution system in the absence of a treatment material. The volume of produced fluid passed through the passive elution system in the absence of a treatment material is not particularly limited. Accordingly, in some embodiments where a treatment material is delivered to the wellbore and is depleted from the elution device, the flow of produced water is continued for a selected period of time following the delivery in order to rinse the treatment chemical completely from the elution device into the wellbore. The volume of produced fluid applied to the elution device during the period of no treatment is not limited. In some such embodiments, a "flush cycle" is advantageously continued for a period of time sufficient to flush at least 2 liters, and as much as 100 liters or even as much as 500 liters of produced water through the passive elution system in the absence of a treatment material, for example about 2 liters to 100 liters, 5 liters to 100 liters, 10 liters to 100 liters, 15 liters to 100 liters, 20 liters to 100 liters, 25 liters to 100 liters, 30 liters to 100 liters, 40 liters to 100 liters, 50 liters to 100 liters, 60 liters to 100 liters, 70 liters to 100 liters, 80 liters to 100 liters, 90 liters to 100 liters, 2 liters to 90 liters, 2 liters to 80 liters, 2 liters to 70 liters, 2 liters to 60 liters, 2 liters to 50 liters, 2 liters to 40 liters, 2 liters to 30 liters, 2 liters to 20 liters, 2 liters to 10 liters, 2 liters to 5 liters, 5 liters to 10 liters, 10 liters to 20 liters, 20 liters to 30 liters, 30 liters to 40 liters, 40 liters to 50 liters, 50 liters to 60 liters, 60 liters to 70 liters, 70 liters to 80 liters, 80 liters to 90 liters, 100 liters to 200 liters, 200 liters to 300 liters, 300 liters to 400 liters, or 400 liters to 500 liters of produced water flushed through the passive elution system in the absence of a treatment material.

In embodiments where a continuous or a batch-type treatment is followed by a period of no treatment, a continuous flow of produced fluid is applied to the elution device during the treatment and also during the period of no treatment. In such embodiments the volume of produced water flowing through the passive elution system in the absence of a treatment material is determined by the operator, specifically when the operator either adds fresh treatment material to the elution device to start a new wellbore treatment, or allows the treatment to be depleted without adding fresh treatment material for a selected period of time; or shuts off the flow of the side stream of produced fluid through the elution device.

Unexpectedly, the passive elution systems are operable by obtaining any rate of flow of produced fluid from a producing wellbore, even very low flow rates such as 1 liter per hour or less.

Unexpectedly, the passive elution systems herein obtain treatment of the entire production string and not just portions of the production tubing situated above the earth; and obtaining such treatment does not require injection of any treatment materials into the subterranean reservoir beyond the wellbore itself. Accordingly, treatment materials are employed efficiently to treat every surface of the production string, without applying treatment materials where they are not needed or where the treatment materials may cause environmental damage. Further, this result is achieved even for flow rates such as 1 liter per hour or less, as noted above.

Accordingly, the passive elution systems herein obtain a greater efficiency in treating a production string than batchwise treatments conventionally applied periodically to producing wellbores. For example, a batchwise treatment employing 16 liters of a treatment material having 4.5 wt % actives and flushed into a wellbore using 3 barrels of water obtained suitable treatment for one week, while the same amount of treatment material actives provided either in a treatment liquid or a composite treatment solid and applied to a passive elution device in accordance with FIG. 2 provided continuous treatment of the wellbore for at least 9 days.

Fifth Embodiments

Due to the efficiency of the passive elution systems described herein for treating a production string, combined with the reliance of the systems on a flow of produced fluid derived from a producing subterranean reservoir for operability instead of pumps or other mechanisms, the dimensions of one or more passive elution systems of any of first through fourth embodiments is suitably designed to be compact, that is, suitably designed and adapted for case of transport between locations. Accordingly, in fifth embodiments herein, a passive elution system of any of first through fourth embodiments herein is provided as a kit having two or more component parts for assembly thereof, that is, a mobile elution kit.

The mobile elution kit of fifth embodiments may be suitably transported to a location proximal to a wellbore in need of treatment, and assembled at the location to form an operable passive elution system as described in first through fourth embodiments herein. In fifth embodiments, an operable passive elution system formed from a mobile elution kit may subsequently be disassembled, for example after one or more uses in treatment of a wellbore; and the mobile elution kit re-formed.

In embodiments, one or more use cycles are suitably carried out using a mobile elution kit, where one use cycle includes the steps of a) assembling a mobile elution kit to form a passive elution system in fluid contact with a wellbore; b) treatment of the wellbore by allowing an eluting contact of a produced water from the wellbore with a treatment material disposed within the elution device of the passive elution system; and c) disassembly of the passive elution system and reformation of the mobile elution kit. Optionally, the mobile elution kit is transported to one or more different locations between any one or more use cycles, that is, after completing disassembly in accordance with step c). In embodiments, the transportation to a different location of the mobile elution kit is followed by reassembly in accordance with step a), or by storage of the kit between use cycles. In any one or more such embodiments, the mobile elution kit is of a size and weight suitable for transportation using a standard street vehicle such as the bed of a pickup truck or even the trunk of a compact sedan; in embodiments, the mobile elution kit is sufficiently small to be transported using e.g. a handcart or a dolly. In some fifth embodiments, between 2 and 10,000 use cycles are obtained using a single mobile elution kit, such as 10 to 10,000 cycles, or 100 to 10,000 cycles, 1,000 to 10,000 cycles, or 10 to 1,000 cycles, or 100 to 1,000 cycles.

In one representative example of a method of using a mobile elution kit of fifth embodiments, a mobile elution kit is transported to a first location proximal to a first wellbore, and assembled proximal to the first wellbore to form a passive elution system, including establishing fluid communication with a side stream flow of a produced fluid from a production tube of the first wellbore; a treatment material is eluted from the passive elution system into the first wellbore using any one of the foregoing described methods; then the passive elution system is disassembled to re-form the mobile elution kit, and the mobile elution kit is transported to a second location proximal to a second wellbore, reassembled proximal to the second wellbore to form a passive elution system, and a treatment material is eluted from the passive elution system into the second wellbore. In this manner, a mobile elution kit is suitably used in two different locations. The foregoing representative example may be repeated hundreds or thousands of times, as noted above. In some embodiments, one or more of the following are suitably carried out in a single 24 hour period of time: the mobile elution kit is assembled to form a passive elution system; a treatment material is eluted into a wellbore from the assembled passive elution system; the assembled passive elution system is disassembled to re-form the mobile elution kit. In embodiments, the foregoing 24 hour period further includes transporting the mobile elution kit to the wellbore, transporting the mobile elution kit from the wellbore, or both transporting the mobile elution kit to the wellbore and transporting the mobile elution kit from the wellbore.

By "sufficiently compact for transporting easily between locations" mentioned above, it is meant that the mobile elution kit includes a mobile elution device, which is an elution device in accordance with any of the first or second embodiments herein that is selected to obtain interior dimensions of height of about 20 cm to 200 cm; and where generally cylindrical in shape, an inner diameter of about 5 cm to 100 cm. In embodiments, a mobile elution device is selected to obtain a maximum exterior dimension of about 25 cm to 150 cm, such as about 25 cm to 125 cm, or about 50 cm to 150 cm, or about 25 cm to 100 cm, or about 50 cm to 100 cm, or about 25 cm to 75 cm, or about 30 cm to 60 cm. In embodiments, the interior volume of the mobile elution device obtains a generally cylindrical shape with an aspect ratio of height to diameter between 1 and 100, for example 2 to 100, 3 to 100, 5 to 100, 10 to 100, 25 to 100, 50 to 100, 1 to 2, 2 to 3, 3 to 5, 5 to 10, 10 to 20, 20 to 30, 30 to 40, 40 to 50, 50 to 60, 60 to 70, 70 to 80, 80 to 90, or 90 to 100.

In fifth embodiments, a mobile elution kit includes a mobile elution device. In some fifth embodiments, a mobile elution kit includes a mobile elution device and one or more mobile conduits. The mobile elution device, and the one or more mobile conduits where included in a mobile elution kit, are adapted and configured for assembly to form a sealed fluid connection with a produced fluid flow received from a wellbore, such as a side stream of a production tube, resulting in a passive elution system as described in any of first through fourth embodiments herein, further wherein the passive elution systems formed from the mobile elution kits are capable of operating to provide wellbore treatments by obtaining a flow of produced fluid that emanates above the surface of the earth, and dispensing a treated flow at or beneath the surface of the earth, as described in first through fourth embodiments herein.

Figure 3:
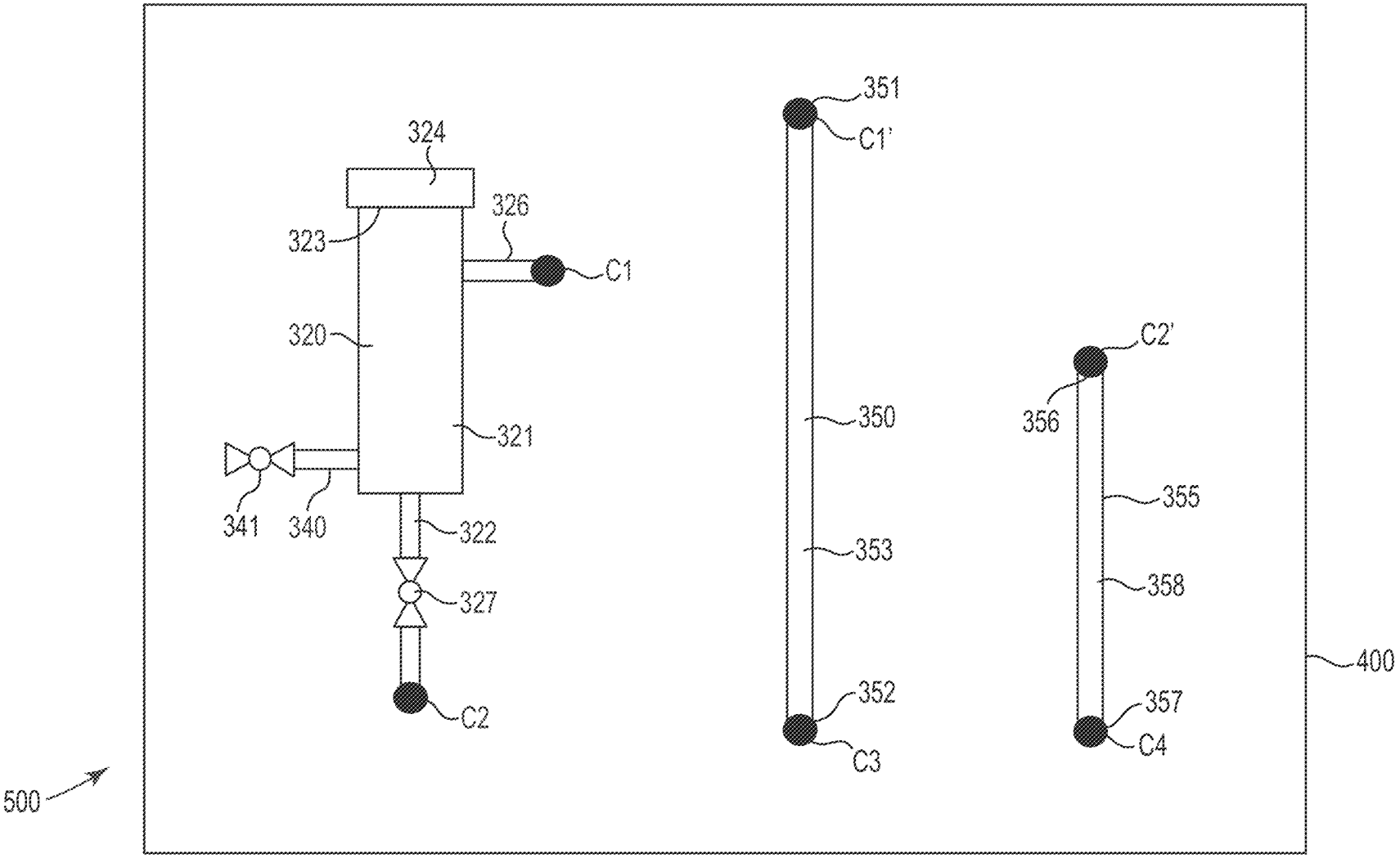
FIG. 3 is a diagram of a mobile elution kit of fifth embodiments herein.

FIG. 3 shows one representative but non-limiting example of a mobile elution kit of fifth embodiments. As shown in FIG. 3, mobile elution kit 500 includes mobile elution device 320, mobile conduits 350, 355, and storage containment 400 surrounding mobile elution device 320 and mobile conduits 350, 355. Carrying case 400 is optionally included as part of a mobile elution kit to provide convenient and/or safe storage and/or transportation of mobile elution device 320 and/or mobile conduits 350, 355.

As shown in FIG. 3, mobile elution device 320 is a containment defining an interior volume 321 having an inlet 326 thereto, an outlet 322 thereto, and removable cap 324, similarly to the elution devices of second embodiments above, such as the elution device 220 shown in FIG. 2. In other embodiments, a mobile elution device is a containment that is configured similarly to the elution devices of first embodiments above, such as the elution device 120 shown in FIG. 1. In FIG. 3, inlet 326 includes a connector C1 appended thereto, and outlet valve 327 is disposed between outlet 322 of elution device 220 and second connector C2. Optionally, a treatment material disposed within interior volume 321: that is, in embodiments, the mobile elution device includes a treatment material pre-loaded therein. In other embodiments, a treatment material is not added to the mobile elution device until a passive elution system is assembled from the mobile elution kit. In embodiments, the general shape and features of the mobile elution device 320 are similar to or even the same as elution device 220 in FIG. 2.

Also as shown in FIG. 3, mobile elution device 320 of mobile elution kit 500 includes an exit outlet 340 having exit valve 341 appended thereto. Exit outlet 340 provides fluid communication between the interior volume 321 of mobile elution device 320 and the atmosphere, such that exit valve 341 may be manually opened to allow the contents of the mobile elution device to be emptied when desired, such as in preparation for disassembly of a passive elution system formed using the mobile elution kit 500. In some embodiments, exit valve 341 is a pressure-responsive valve, that automatically opens to empty some of the contents of the elution device 320 when a fluid pressure within interior volume 321 exceeds a value specified by the pressure-responsive valve manufacturer.

Further as shown in FIG. 3, mobile elution device 320 includes connector C1 appended to inlet 326, and connector C2 appended to outlet valve 327. Connector C1 is capable of forming a mated connection with a mated counterpart connector, C1' and connector C2 is capable of forming a mated connection with a mated counterpart connector, C2'.

FIG. 3 also shows mobile conduits 350 and 355 of mobile elution kit 500. Mobile conduits 350, 355 are annular conduits individually selected to have an interior diameter of 1 mm to about 20 cm, or about 3 mm to about 20 cm, or about 5 mm to about 20 cm, or about 1 cm to about 20 cm, or about 2 cm to about 20 cm, or about 2 cm to about 20 cm, or about 3 cm to about 20 cm, or about 4 cm to about 20 cm, or about 5 cm to about 20 cm, or about 7 cm to about 20 cm, or about 9 cm to about 20 cm, or about 10 cm to about 20 cm, or about 12 cm to about 20 cm, or about 14 cm to about 20 cm, or about 16 cm to about 20 cm, or about 18 cm to about 20 cm, or about 1 mm to about 18 cm, or about 1 mm to about 16 cm, or about 1 mm to about 14 cm, or about 1 mm to about 12 cm, or about 1 mm to about 10 cm, or about 1 mm to about 8 cm, or about 1 mm to about 6 cm, or about 1 mm to about 4 cm, or about 1 mm to about 3 cm, or about 1 mm to about 2 cm, or about 1 mm to about 1 cm, or about 1 mm to about 5 mm, or about 1 cm to about 2 cm, or about 2 cm to about 3 cm, or about 3 cm to about 4 cm, or about 4 cm to about 6 cm, or about 6 cm to about 8 cm, or about 8 cm to about 10 cm, or about 10 cm to about 12 cm, or about 12 cm to about 14 cm, or about 14 cm to about 16 cm, or about 16 cm to about 18 cm, or about 5 mm to about about 3 cm, or about 1 mm to about 5 mm, or about 5 mm to about 1 cm, or about 1 cm to about 10 cm, further wherein mobile conduits are individually selected to have an interior diameter suitable for use in operably assembling a passive elution system for obtaining a selected flow rate of produced fluid, as described in first, second, and fourth embodiments above. Further as shown in FIG. 3, mobile conduits 350, 355 have selected lengths for use in operably assembling a passive elution system; however, it will be understood that mobile conduits in other embodiments of the mobile elution kits of fifth embodiments are individually selected to have any length suitable for use in operably assembling a passive elution system. Accordingly, any length of mobile conduit may be further selected for optimum mobility.

Mobile conduits 350, 355 are individually selected to comprise, consist essentially of, or consist of metal pipe, plastic tubing, flexible rubber or plastic hose, metal-reinforced hose or tubing, corrugated flexible metal hose, or any combination thereof. Mobile conduits 350, 355 are substantially straightforward as shown in FIG. 3, but in one or more other embodiments are individually designed with one or more curved or bent portions, as required for assembly to form a passive elution system. Alternatively, mobile conduits 350, 355 formed from a flexible material such as metal-reinforced rubber hose or corrugated flexible metal hose may obtain one or more curved portions during assembly of the corresponding mobile elution kit to form a passive elution system.

First mobile conduit 350 has first end 351 and second end 352 defining a length 353 therebetween; connector C1' appended to first end 351, and connector C3 appended to second end 352. Connector C1 of mobile elution device 320 is capable of connecting to connector C1' of first mobile conduit 350 to result in mated connection C1-1' (not shown). Connectors C1, C1' are mated connector pairs, typically configured as "male" and "female" pairs; and are designed and adapted to be connected to form a sealed fluid connection, also referred to herein as a joint, when mated. Accordingly, connectors C1 and C1' as shown in mobile elution kit 500 of FIG. 3 are designed and adapted to be connected, or joined, to form joint C1-1', that is sealed fluid connection C1-1' between mobile elution device 320 and mobile conduit 350.

As is understood by those of skill in the art of constructing continuous fluid conduits for the transfer of produced petrochemical fluids, the ends of two conduits or pipes may be joined axially to form a single conduit that is used to communicate a fluid from one point to another, such as between two vessels, containers, other fluid conduits, or combinations thereof. There are numerous methods currently used in the pipe and pipeline construction industry to obtain a secure fluid connection. Push-to-connect joints and mechanical joints utilizing conventional threaded connections, are usefully employed to form joint C1-1' for example, since these types of connectors can be suitably designed for simple, rapid joining in the field without the need to use specialized tools, special techniques such as e.g. welding, or heavy equipment; and further can be designed so that a joint, for example joint C1-1', resists tension and thereby prevents the connection from pulling apart when the assembled passive elution system is subjected to internal pressure from the flow of a side stream of produced fluid; and further can be designed for simple, rapid de-coupling or disassembly without specialized tools, special techniques, or heavy equipment. Joining conduits by means of a threaded connection typically utilizes the use of a coupling (e.g., a union connector), which generally comprises a short tubular hollow piece that is larger in outer diameter than the conduit and is threaded on its inside diameter. Such connections are often custom made. Suitable mated pairs of push-to-connect joints, also referred to in the industry as "quick disconnect" joints, are available from several sources, including McMASTER-CARR® of Elmhurst, IL and Beswick Engineering Co., Inc. of Greenland, NH.

Accordingly, in fifth embodiments herein, mated connector pairs such as connectors C1 of mobile elution device 230 and C1' of mobile conduit 350 that are configured for simple, rapid joining to form joint C1-1', and also rapid decoupling of joint C1-1', are particularly suitable for use in the assembly of passive elution systems from the mobile elution kits. Such connectors are referred to herein as rapid connectors. Rapid connector pairs are mated rapid connectors, typically having male/female mated configurations, that are designed and adapted to be connected and also disconnected quickly and without the use of specialized tools or techniques, and further may be connected and disconnected multiple times, wherein each connection results in a sealed fluid connection.

With reference to FIG. 3, second mobile conduit 355 has first end 356 and second end 357 defining a length 358 therebetween, connector C2' appended to first end 356, and connector C3 appended to second end 357. Similarly to rapid connector pair C1 and C1', connector C2 and C2' are a rapid connector pair that is capable of forming a sealed fluid connection.

Further in FIG. 3, connector C3 of mobile conduit 350 and connector C4 of mobile conduit 355 are configured to obtain a sealed fluid connection with a side stream of a production tube. In embodiments, connector C3 and connector C4 are rapid connectors. In embodiments, connector C3 is adapted and configured to form a sealed fluid connection with a connector C3' located in fluid communication with a side stream of a production tube, forming joint C3-3'. In some such embodiments, connector C3 of mobile conduit 350 and C3' of mobile conduit 350 are configured for simple, rapid joining to form joint C3-3', and also rapid decoupling of joint C3-3'. In other embodiments, connector C3 is a conventional connector, not a rapid connector, and is configured and adapted to be affixed permanently or semi-permanently in fluid communication with a side stream of a production tube, using conventional joining methods. In such embodiments, mobile conduit 350 is left in place as affixed to the production tube; wherein the affixed mobile conduit 350 includes rapid connector C1' for rapid joining with rapid connector C1 of elution device 320 to form joint C1-1', and also facilitates rapid disassembly, that is, decoupling, of joint C1-1'.

In embodiments, connector C4 is adapted and configured to form a sealed fluid connection with a connector C4' that in turn is in fluid communication with a wellbore, to form joint C4-4'. In some such embodiments, C4 and C4' are a rapid connector pair. In other embodiments, connector C4 is a conventional connector, not a rapid connector, and is configured and adapted to be affixed permanently or semi-permanently in fluid communication with a wellbore to obtain a fluid flow therein, using conventional joining methods. In embodiments, C4 is adapted and configured to join directly to one or more infrastructural features of a wellbore, further wherein the direct joining of mobile conduit 355 connector C4 obtains a suitable position of mobile conduit 355 to form joint C2-2' with mobile elution device 320, and further to receive a treated produced fluid flow from outlet 322 through valve 327 of mobile elution device 320. In still other embodiments, mobile conduit 355 excludes a connector at second end 357, and instead second end 357 is open, and is configured and adapted to dispense a fluid flow directly into a wellbore.

In embodiments where connectors C3 and C4 are conventional connectors, and both mobile conduits 350 and 355 are permanently or semi-permanently attached, mobile elution kit 500 may include only mobile elution device 320, having connectors C1 and C2 as shown in FIG. 3, whereupon joint C1-1' and joint C2-2' may be joined to obtain a passive elution system as described in second embodiments herein. In such embodiments, mobile elution kit 500 may be replenished with one or more freshly prepared mobile conduits 350, 355 for affixing to a different wellbore/production side stream.

Accordingly, in fifth embodiments herein, a mobile elution kit is assembled to form a passive elution system, in operable fluid contact with a wellbore as described in any one of first through fourth embodiments above. One or more methods of assembling a mobile elution kit of fifth embodiments to form a passive elution system are available depending on the type of elution device is selected, e.g. such as elution device 120 of FIG. 1 or elution device 220 of FIG. 2; available flow rate of produced water in a production tube side stream; and type of treatment material present in or added to the selected elution device. The assembled mobile elution kit is a passive elution system in accordance with any one of first through fourth embodiments herein, and therefore is capable of passively receiving a produced fluid flow from a wellbore, directing the produced fluid flow into an eluting contact with a treatment material to form a treated produced fluid flow, and direct the treated produced fluid flow into the wellbore.

In embodiments such as the mobile elution kit 500 of FIG. 3, assembly of a mobile elution kit of fifth embodiments to form a passive elution system includes positioning the mobile elution device 320 on or above the surface of the earth, or substantially on or above the surface of the earth, and proximal to a wellhead of a producing wellbore, and further wherein inlet 326 is situated at or near the gravitational top of the situated mobile elution device 320. In embodiments the assembling further includes connecting mobile conduit 350 connector C3 to a mated connector C3' (not shown) present in fluid communication with a produced fluid side stream of the wellbore, such as side stream tubing 110 or side stream valve 113 as shown in FIG. 2. In embodiments the assembling further includes connecting mobile conduit 355 connector C4 to a mated connector C4' (not shown) that is in fluid communication with a conduit positioned to dispense a fluid flow into the wellbore, that is e.g. into well annulus 21 defined by the well casing 20, as shown in FIG. 2. For example, as shown in FIG. 2, connector C4' may be located in fluid communication with dispensing valve 114 or side stream tubing 110 near second end 112.

After connecting first and second mobile conduits 350, 355, the method of assembly of mobile elution kit 500 of FIG. 3 further includes joining the rapid connector pair C1, C1' to form joint C1-1'; and joining rapid connector pair C2, C2' to form joint C2-2', substantially as described above. Upon forming joints C1-1' and C2-2', a passive elution system such as any of the passive elution systems described in first through fourth embodiments herein, and capable of use to treat the wellbore as described in first through fourth embodiments herein, is operably formed. In embodiments, the passive elution system formed using the mobile elution kit 500 of FIG. 3 is similar to passive elution system 200 of FIG. 2; in embodiments, the passive elution system formed using the mobile elution kit 500 of FIG. 3 functions similarly or identically to passive elution system 200 of FIG. 2.

Advantageously, a passive elution system formed from a mobile elution kit of fifth embodiments may further be disassembled, and further subjected to one or more use cycles as described above. In the embodiment above, wherein assembly of mobile elution kit 500 of FIG. 3 includes forming joint C1-1' and C2-2', as described above such rapid connection joints are also easily disassembled with use of specialized techniques or tools or any heavy equipment. Accordingly, one or more use cycles may be suitably carried out using mobile elution kit 500 of FIG. 3.

Other mobile elution kits having mobile elution devices designed similarly to elution device 120 shown in FIG. 1, or another design, may suitably be provided in accordance with fifth embodiments herein. In some fifth embodiments, a mobile elution device is further mounted on a support, as noted for any of first and second embodiments above.

Additionally, in accordance with the use of a passive elution system as described in first through fourth embodiments herein, a passive elution system formed from a mobile elution kit of fifth embodiments may include a treatment material. In embodiments, the treatment material is preloaded into a mobile elution device present in a mobile elution kit; in other embodiments, the treatment material is added to the mobile elution device after assembly of the mobile elution kit to form a passive elution system.

In alternative fifth embodiments herein, further as mentioned above, elution device 320 of FIG. 3 is provided as a single component of the mobile elution kit, that is, mobile conduits 350, 355 are excluded from the mobile elution kit. In such embodiments, rapid connector C1 of elution device 320 is configured to provide a sealed fluid connection with a mated rapid connector present in fluid communication with a produced fluid side stream of the wellbore; and rapid connector C2 of elution device 320 is configured to connect with a mated rapid connector present in fluid communication with tubing that is capable of directing a fluid flow directly into the wellbore.

In any of the foregoing fifth embodiments, a mobile elution kit further includes one or more additional components for use in assembling, disassembling, or using the mobile elution kit or the passive elution system formed from the mobile elution kit. Such additional components include, for example, one or more containers containing a treatment material therein, wherein the treatment material is suitable for addition to the mobile elution device. Accordingly, a mobile treatment material of such fifth embodiments may be used to replenish a depleted treatment material by addition thereof to the mobile elution device, for example by removing cap 324 from mobile elution device 320 as shown in FIG. 3, and adding the mobile treatment material to the opening 323 of mobile elution device 320. A mobile treatment material is suitably provided in a bulk quantity for apportionment by a user; alternatively, a mobile treatment material is provided in divided portions that correspond to "doses" of an amount that is suitable for addition to a mobile elution device. For example, in embodiments a mobile treatment material is a composite treatment solid comprising a polymer pouch enclosing a treatment liquid, as mentioned above; in some such embodiments, the amount of treatment liquid within a polymer pouch corresponds to a convenient or required dosage of the treatment material to provide treatment of a wellbore in conjunction with the flow rate and mobile elution device design employed.

In some fifth embodiments, the one or more additional components of a mobile elution kit include one or more spare parts for repair of a mobile elution device and/or a connector and/or a conduit in association with the mobile elution kit or the passive elution system formed from the kit. In some fifth embodiments, the one or more additional components of a mobile elution kit include one or more tools for use in assembling or disassembling the mobile elution kit.

EXPERIMENTAL SECTION

Example 1

Effectiveness of corrosion inhibition in all field tests herein was evaluated using the Copper Ion Displacement (CID) test method. The CID method includes taking a sample of produced fluid from a well head, soaking a 1018 carbon steel coupon in the produced fluid sample for 12-24 hours, taking the coupon out of the produced fluid sample and dipping it into 100 mL of a copper sulfate solution prepared by dissolving 10 grams of cupric sulfate and 100 mL of distill water; and observing coupon surface. The copper sulfate contact causes corroded areas of the coupon surface to obtain a brownish or copper color (lighter) appearance; whereas the uncorroded areas of the couple surface obtain a black (darker) appearance. An estimate of the percentage of the uncorroded area of a coupon surface can thus be obtained, and this estimate is used to determine the relative effectiveness of a corrosion inhibitor treatment. A relatively higher estimated percentage of uncorroded areas indicates that a particular corrosion inhibition treatment is relatively more effective.

A producing well in the Permian basin was used for a field test of a passive elution device constructed as shown in FIG. 2. The elution device (220 in FIG. 2) was a column having an inner diameter of 4 inches (10 cm) and length of 4 feet (1.2 meter). The selected well produced approximately 300 barrels of total fluids per day with about 2.6% oil by volume. Up until one week prior to initiating the test below, the well had been treated weekly with a batch treatment of a corrosion inhibitor, CI-1, using a treater truck. CI-1 includes about 18% corrosion inhibitor actives by weight in a solvent mixture including light aromatic naphtha, methanol, and 1,2,4-trimethylbenzene. The corrosion inhibitor actives include quaternary ammonium compounds, fatty amide polymer, alkylamines, and fatty acid/amine derivatives. For each treater truck batch treatment, 4 liters of CI-1 was diluted with 12 liters of fresh water and the diluted corrosion inhibitor product was dispensed in a single batch into the annulus of the well. Subsequently, three barrels of fresh water from the treater truck were dispensed into the annulus to flush down the batch, for a total of 15 liters of fresh water per 4 liters of treatment mixture.

One week after a batch treatment in accord with the foregoing, 4 liters of CI-1 was encapsulated in water soluble film pouches and applied to a passive elution device in accordance with FIG. 2. The film was made of poly(vinyl alcohol) polymer having a thickness of 75 micron. The film was cut into 2 inch×4 inch (5.1 cm×10.2 cm) pieces; two pieces of film were stacked together and sealed on three sides using an impulse heat scaler, to result in an open pouch (pouch having an opening). Each open pouch was filled with the corrosion inhibitor via the opening, and then the pouch was sealed off with an impulse heat sealer. In this manner, about 100 pouches were formed, and each 2"×4" pouch contained about 40 to 50 mL of CI-1 product.

The pouches were applied to a passive elution device configured as shown in FIG. 2. During the pouch treatment, a flow of produced fluid from the production flow line at the well head was diverted to the elution device to fill the interior volume of the device. The pouches were allowed to reside within the filled elution device for two minutes; and then the elution device was flushed with the diverted flow continuously for 5 minutes. The diverted flow rate was about 100 liter/minute during the 5 min flush. After the pouch treatment was completed, no further treatments of any kind were applied to the well for 9 days.

Nine days after the pouch treatment, fluid collected from the well head fluid stream was tested using the CID coupon test described above. The CID test coupon exhibited no sign of corrosion (100% black coupon surface).

This result shows that using the same amount of the same corrosion inhibitor, batch-type treatments applied with the passive elution devices and methods of use described herein obtain excellent corrosion protection for a longer period of time (at least 9 days) than conventional batch treatments using the same treatment material (7 days).

Example 2

A corrosion treatment test was conducted using the same passive elution device on the same well as in Example 1. In this test, 1 liter of a corrosion inhibitor, CI-2, was encapsulated in a series of 1.75 inch×11 inch (4.45 cm×27.9 cm) water soluble pouches prepared using the same procedure as described in Example 1, such that each pouch contained about 95 mL of CI-2. The CI-2 product includes about 72% corrosion inhibitor actives by weight in a solvent mixture including light aromatic naphtha, methanol, and 1,2,4-trimethylbenzene. The corrosion inhibitor actives include the same quaternary ammonium compounds, fatty amide polymer, alkylamines, and fatty acid/amine derivatives as CI-1. The pouches were loaded, soaked and flushed using the same procedure as described in Example 1.

CID coupons were tested on well head fluids samples collected from the well head both before and after the treatment, using the procedure outlined in Example 1. A first CID test conducted one day before the treatment showed corrosion on about 90% of the coupon surface (brown/copper color). A second CID test conducted with well head fluid collected one day after the treatment also exhibited no sign of corrosion (100% black coupon surface). A third CID test conducted with well head fluid collected 13 days after the treatment exhibited about 65% corrosion (about 35% black coupon surface).

We have previously found that use of the CI-2 product in a conventional weekly batch-type treatment applied by a treated truck requires 4 liters of CI-2 to be flushed into the well in order to provide effective corrosion inhibition for 7 days. However, by applying 1 liter of CI-2 to the well annulus via the passive elution device configured as in FIG. 2, corrosion protection commensurate with the protection provided by once-weekly batch application of 4 liters of CI-2 using a treater truck was obtained. In addition to the benefits of using the passive elution device to apply the corrosion inhibitor pouches as mentioned in Example 1, this result demonstrates that amount of a treatment material used to treat a well can be reduced to one-fourth of the amount required by the treater truck batch treatment, and the same or similar performance of the treatment material is obtained over the same amount of time.

What is claimed is:

1. A passive elution system comprising an elution device defining an interior volume having an outlet therefrom, the outlet situated at or proximal to a bottom of the elution device, wherein the interior volume comprises a treatment solid or a composite treatment solid, and wherein the elution device excludes an inlet;

an elution assemblage in fluid communication with the outlet; and a conduit in fluid communication with the elution assemblage and arranged and adapted to receive a produced fluid flow from a wellbore of a subterranean reservoir at a location above a surface of the earth, direct the produced fluid flow to provide an eluting contact with the treatment solid or the composite treatment solid within the elution assemblage to form a treated produced fluid flow, and direct the treated produced fluid flow into the wellbore.

2. The passive elution system of claim 1 wherein the elution device is situated on or above the surface of the earth, and the treated produced fluid flow is directed into the wellbore at a location at or below the surface of the earth.

3. The passive elution system of claim 1 wherein the produced fluid flow received from the wellbore is a side stream of a production tube.

4. The passive elution system of claim 1 wherein the passive elution system excludes external or applied sources of power to receive the produced fluid flow, direct the produced fluid flow to provide the eluting contact with the treatment solid or the composite treatment solid, or direct the treated produced fluid flow into the wellbore.

5. The passive elution system of claim 1 wherein the elution assemblage is a basket.

6. A passive elution system comprising an elution device defining an interior volume having an inlet and an outlet, the inlet operably situated on or proximal to a top of the elution device, the outlet operably situated on or proximal to a bottom of the elution device, wherein the interior volume comprises a treatment material;

a first conduit in fluid communication with the inlet and arranged and adapted to receive a produced fluid flow from a wellbore of a subterranean reservoir at a location above a surface of the earth, and direct the produced fluid flow through the inlet to provide an eluting contact with the treatment material to form a treated produced fluid; and a second conduit in fluid communication with the outlet and arranged and adapted to receive the treated produced fluid and direct the treated produced fluid into the wellbore, wherein the treatment material is a composite treatment solid comprising a polymer pouch enclosing a treatment liquid.

7. The passive elution system of claim 6 wherein the elution device is situated on or above the surface of the earth, and the treated produced fluid flow is directed into the wellbore at a location at or below the surface of the earth.

8. The passive elution system of claim 6 wherein the produced fluid flow received from the wellbore is a side stream of a production tube.

9. The passive elution system of claim 6 wherein the passive elution system excludes external or applied sources of power to receive the produced fluid flow, direct the produced fluid flow to provide the eluting contact with the treatment material, or direct the treated produced fluid flow into the wellbore.

10. The passive elution system of claim 6 further comprising a float valve operably disposed in the interior volume of the elution device to stop the produced fluid flow through the inlet; and an outlet valve disposed between the outlet and the second conduit.

11. A method of treating a wellbore of a subterranean reservoir, the method comprising: obtaining a side stream flow of a produced fluid from a production tube of the wellbore, at a location above a surface of the earth; directing an eluting contact of the side stream flow of the produced fluid with a treatment material to form a side stream flow of treated produced fluid; and directing the side stream flow of treated produced fluid into the wellbore at a location at or below the surface of the earth, where the treatment material is a composite treatment solid comprising a polymer pouch enclosing a treatment liquid.

12. The method of claim 11 wherein the treating is batch treating.

13. The method of claim 12 wherein the batch treating is provided by continuous eluting contact of the produced fluid with the treatment material.

14. The method of claim 11 wherein the side stream flow of produced fluid is obtained at a flow rate of 1 liter per hour to 10 liters per second.

15. The method of claim 11 further comprising measuring a value related to a property of the produced fluid, measuring a value related to a property of the treated produced fluid, or both; and communicating one or more values to a controller; wherein the controller is designed and adapted to respond to one or more communicated values by manipulating a rate of the side stream flow.

16. An elution kit comprising an elution device having a top and a bottom and defining an interior volume therebetween, the interior volume defining an inlet and an outlet, the inlet situated on or proximal to the top of the elution device and appended by a first connector, the outlet situated on or proximal to the bottom of the elution device and appended by a second connector, wherein the interior volume comprises a treatment material;

a first conduit having a first conduit first end and a first conduit second end, wherein the first conduit first end is appended by a first mated connector for mating with the first connector of the elution device to form a first sealed fluid connection, and wherein the first conduit second end is appended by a third connector, wherein the third connector is adapted and configured to obtain a fluid connection with a flow of produced fluid from a production tube of a wellbore; and a second conduit having a second conduit first end and a second conduit second end, wherein the second conduit first end appended by a second mated connector for mating with the second connector of the elution device to form a second sealed fluid connection, and wherein the second conduit second end is appended by a fourth connector, wherein the fourth connector is configured to obtain a fluid communication with tubing that is capable of directing a fluid flow directly into the wellbore.

17. The elution kit of claim 16 wherein the first connector and the first mated connector are a first rapid connection pair; and the second connector and the second mated connector are a second rapid connection pair, wherein the first and second rapid connection pairs are independently selected from push-to-connect connection pairs or threaded connection pairs.

18. A method of using the elution kit of claim 16, wherein the method includes the steps in order of: a) assembling the elution kit to form a passive elution system in fluid contact with a wellbore; b) treating the wellbore by allowing an eluting contact of a produced water from the wellbore with the treatment material; and c) disassembling the passive elution system to reform the elution kit.

19. The method of claim 18 wherein steps a)-c) are repeated 2 to 10,000 times.

20. The method of claim 19 further comprising transporting the elution kit after any one or more step c).

21. A method of treating a wellbore of a subterranean reservoir, the method comprising: obtaining a side stream flow of a produced fluid from a production tube of the wellbore; directing a continuous eluting contact of the side stream flow with a composite treatment material to form a contacted side stream flow; and directing the contacted side stream flow into the wellbore at a location at or below a surface of the earth, wherein the composite treatment material comprises a polymer pouch enclosing a treatment liquid.

22. The method of claim 21 wherein the treating is batch treating.

23. The method of claim 21 wherein the treating is continuous treating.

24. The method of claim 21 further comprising controlling the continuous eluting contact of the side stream flow by manipulating a side stream control valve.

25. The method of claim 21 wherein the side stream flow of produced fluid is obtained at a flow rate of about 1 liter per hour to 10 liters per second, or at a flow rate of about 100 liters per hour to about 3500 liters per hour.

* * * * *